US005456194A

United States Patent [19]

Badillo

[11] Patent Number: 5,456,194

[45] Date of Patent: Oct. 10, 1995

[54] MATERIAL TRANSFER ASSEMBLY FOR PATTERN TACKER SEWING MACHINE

[75] Inventor: Paul Badillo, Littleton, Colo.

[73] Assignee: Ralph's Industrial Sewing Machine Company, Denver, Colo.

[21] Appl. No.: 310,951

[22] Filed: Sep. 23, 1994

Related U.S. Application Data

[63] Continuation-in-part of Ser. No. 286,640, Aug. 5, 1994, which is a continuation-in-part of Ser. No. 24,687, Mar. 1, 1993, Pat. No. 5,339,756, which is a continuation of Ser. No. 764,332, Sep. 23, 1991, Pat. No. 5,193,471, which is a continuation-in-part of Ser. No. 633,497, Dec. 26, 1990, Pat. No. 5,158,026.

[51] Int. Cl.[6] ..... D05B 21/00; D05B 3/06

[52] U.S. Cl. ..... 112/470.14; 112/68; 112/470.18; 112/475.25

[58] Field of Search ..... 112/68, 121.15, 112/264.1, DIG. 2, 66, 70, 73, 320

[56] References Cited

U.S. PATENT DOCUMENTS 4,501,207 2/1985 Miyazaki .

*Primary Examiner*—Clifford D. Crowder
*Assistant Examiner*—Paul C. Lewis
*Attorney, Agent, or Firm*—Sheridan Ross & McIntosh

[57] ABSTRACT

A material transfer assembly for transferring stitchable materially laterally in the "x" dimension relative to the arch clamp of a pattern tacker sewing machine. In one embodiment, the material transfer assembly includes a housing which may be attached to the arch clamp and a material clamp member slidably engagable with the housing to affect movement of the stitchable material relative to the arch clamp. One embodiment of the assembly is adapted for use with a sewing and stitchable material cutting assembly to transfer material between sewing and material cutting areas.

34 Claims, 23 Drawing Sheets

MATERIAL TRANSFER ASSEMBLY FOR PATTERN TACKER SEWING MACHINE

RELATED APPLICATIONS

This application is a continuation-in-part of U.S. patent application Ser. No. 08/286,640, filed Aug. 5, 1994 and entitled "SEWING AND MATERIAL REMOVAL ASSEMBLY", which is a continuation-in-part of Ser. No. 024,687, filed Mar. 1, 1993, now U.S. Pat. No. 5,339,756, issued Aug. 23, 1994, which is a continuation of Ser. No. 764,332, filed Sep. 23, 1991, now U.S. Pat. No. 5,193,471, issued Mar. 16, 1993, which is a continuation-in-part of Ser. No. 633,497, filed Dec. 26, 1990, now U.S. Pat. No. 5,158,026, issued Oct. 27, 1992.

FIELD OF THE INVENTION

The present invention generally relates to sewing and material cutting operations and, more particularly, to a stitchable material transfer assembly for moving stitchable material between a pattern tacker sewing machine and a stitchable material cutting device.

BACKGROUND OF THE INVENTION

A class of sewing machines, generally referred to herein as "pattern tacker" sewing machines, utilize a sewing needle and a movable arch clamp (which moves relative to the head of the sewing machine) for moving a stitchable material relative to a vertically reciprocating sewing needle to sew a particular pattern on the stitchable material. Generally, pattern tackers are capable of sewing multiple patterns and thus allow a user increased versatility. One type of pattern tacker is a programmable sewing machine which includes a computer or equivalent device for storing a variety of sewing patterns which can be accessed and selected by a user. When a particular pattern is selected, the computer controls the movement of the arch clamp (relative to the head of the sewing machine), and hence the stitchable material, relative to the vertically reciprocating sewing needle to generate the selected sewing pattern. More specifically, the computer is interconnected with an arch clamp drive assembly which is capable of providing three-dimensional movement to the arch clamp. Typically, during sewing operations the arch clamp moves along a laterally positioned shaft or rod in the "x" direction or dimension (e.g., perpendicularly to the sewing head), as well as inwardly and outwardly in the "y" direction or dimension (e.g., parallel to the sewing head) via an extendable/retractable shaft or rod positioned perpendicularly to the noted lateral shaft or rod. Depending of course upon the length of the laterally positioned shaft or rod, the arch clamp may have the ability to move laterally outside of the sewing area (e.g., that general area in which sewing operations are performed), for instance to transfer the stitchable material to a material removal assembly as described in U.S. Pat. No. 5,339,756.

A number of devices have been developed to expand the movement of programmable sewing machine pattern tackers in the "x" dimension for sewing larger patterns. For instance, U.S. Pat. No. 5,337,684, issued Aug. 16, 1994 and assigned to the assignee of this patent application, discloses an expansion kit for a programmable sewing machine which effectively alters the time period between which the two extreme limit switches are tripped. These limit switches control the range of movement of the arch clamp in the "x" dimension. Moreover, the assignee of this patent application has manufactured and sold another type of expansion kit for a programmable sewing machine which is illustrated in FIG. 19.

Generally, the expansion kit 800 of FIG. 19 includes a double acting pneumatic cylinder 810 which is mounted on the arch clamp 820 of a programmable sewing machine (e.g., generally similar to the machine 16 of FIG. 1) by a shift clamp housing 830. The cylinder 810 has about a 6-inch stroke via an extendable and retractable rod 860, and the programmable machine for which the expansion kit 800 was designed has the ability to sew a pattern of about 6 inches in the "x" dimension.

The rod 860 of the cylinder 810, which is interconnected with the movable, double acting piston (not shown) therein, is fixedly connected to a shift support block 850. A stabilizing rod 840 extends between the ends of the shift clamp housing 830 for supporting the shift block support 850. A work plate 870 is fixedly attached to the lower portion of the shift block support 850. A pallet clamp (not shown) may be attached to the work plate 870 by the pins 880 and pressure clamps 890. Generally, the pallet clamp retains the material to be sewn and has an opening such that the sewing needle can produce the selected sewing pattern. Consequently, once the material to be sewn is properly positioned within the pallet clamp and such is installed on the work plate 870 in the noted manner, the arch clamp 820 will move in the "x" and "y" dimensions to sew one-half of the sewing pattern on the material with the shift support block 850 being in its first position, for instance, an extreme right position as shown in FIG. 19. Thereafters the piston of the cylinder 810 is shifted to its second position to move the shift support block 850 to its second position, for instance to the left of where it is positioned in FIG. 19, such that the other half of the sewing pattern may be produced in the noted manner. Consequently, the expansion kit 800 allows for patterns to be sewn which are up to twice the size in the "x" dimension of the "x" dimension capabilities of the programmable sewing machine.

Another type of pattern tacker is a cam-driven sewing machine in which the movement of the arch clamp (again relative to the sewing head) is controlled by one or more cams. Typically, the range of movement of the arch clamp in the "x" direction or dimension for a cam-driven pattern tacker sewing machine is limited to the sewing area. Consequently, in order to move the stitchable material outside of the sewing area, for instance to provide the stitchable material to a material removal assembly such as that described in U.S. Pat. No. 5,339,756, other methods such as a manual operator transfers have been previously employed.

Pattern tackers again allow the sewing pattern to be changed to provide increased versatility and utilize an arch clamp. However, other types of cam-driven sewing machines are commercially available, but which are capable of performing only one type of operation (e.g., performing only one type of buttonhole sewing operation) and which do not include a moving arch clamp as described above, For instance, a cam-driven unit, which is available from The Reece Button-Hole Machine Co. of Boston, Mass. and marketed under the name "Reece Rapid Button-Hole Machine", includes a stationary sewing head with a movable table positioned below the sewing head. The table moves the stitchable material relative to the sewing needle which is contained within the sewing head. Unlike pattern tackers which utilize only a vertically reciprocating movement for the sewing needle, the sewing needle in the case of the Reece Rapid Button-Hole Machine utilizes a zig-zag movement (i.e., both vertical and lateral movement). Moreover, the Reece Rapid Button-Hole Machine also includes an integral material removal assembly such that eyelet or buttonhole operations may be performed (i.e., the Reece Rapid Button-Hole Machine provides the requisite material removal operation to define an opening in the stitchable material and sews a pattern to define an eyelet or buttonhole). Typically, an indexer (a separate machine) will be used in combination with the Reece Rapid Button-Hole Machine such that more than one sewing and material removal operation may be performed on a given piece of stitchable material (i.e., the indexer will index/sequentially advance the stitchable material such that, for instance, all of the buttonholes of a shirt may be produced by the combination of the Reece Rapid Button-Hole Machine and the indexer).

SUMMARY OF THE INVENTION

The present invention generally relates to a material transfer assembly which is particularly suited for use with a pattern tacker sewing machine, and even more particularly a cam-driven type. Generally, a pattern tacker sewing machine includes a vertically reciprocable sewing needle and an arch clamp. The arch clamp is movable laterally along an "x" axis or in the "x" dimension (e.g., perpendicular to the head of the pattern tacker sewing machine) , longitudinally along a perpendicularly disposed "y" axis or in the "y" dimension (e.g., parallel with the head of the pattern tacker sewing machine) (e.g., the "x" and "y" dimensions being contained within a horizontal reference plane), and vertically along a "z" axis or in the "z" dimension. As such, the arch clamp may be moved in the "z" dimension toward the stitchable material to cause the compressive engagement of the stitchable material in a manner discussed in more detail below, and thereafter may be moved in the "x" and "y" dimensions in a predetermined manner to move the stitchable material relative to the sewing needle and thus to sew a predetermined pattern on the stitchable material.

Generally, the material transfer assembly may be interconnected with the arch clamp and moves the stitchable material in the "x" dimension between at least two positions. The material transfer assembly includes a bottom feed plate which may be fixedly interconnected with the arch clamp (e.g., typically that portion of the arch clamp drive assembly which provides movement in the "x" and "y" dimensions) and which has two laterally displaced holes in the "x" dimension with a continuous, uninterrupted surface therebetween. The assembly further includes a transfer support which may be movably interconnected with the arch clamp. A stitchable material clamp member may be attached to the transfer support, such that downward movement of the arch clamp in the "z" dimension as noted above thus causes the stitchable material clamp member to compressively engage the stitchable material against the bottom feed plate. The material transfer assembly also includes a transfer support drive assembly to move the transfer support relative to the arch clamp between at least two positions. At least a portion of the transfer support will be generally vertically aligned with one of the holes in the bottom feed plate in each of these two positions. Consequently, the material transfer assembly may be used to transfer the stitchable material between a stitchable material cutting assembly (e.g., for producing a hole or opening in the stitchable material and in which the cutting device would pass through one of the holes in the bottom feed plate) and a pattern tacker sewing machine (e.g., for producing a desired sewing pattern on the stitchable material and in which the sewing needle would pass through the other hole in the bottom feed plate), for instance, to provide automated buttonhole and the like operations.

The transfer support is movably interconnectable with the arch clamp. In one embodiment, a housing may be fixedly attached to the arch clamp and the transfer support may be slidably interconnected with this housing. Moreover, the interconnection between the housing and the transfer support may be such that movement of the transfer support relative to the housing and the arch clamp is limited to only in the "x" dimension. Furthermore, the housing may include an appropriate guide for directing the movement of the transfer support (e.g., the housing having a slot and the transfer support having a projection positionable in this slot). In addition, the housing may include two adjustable stops to allow for the independent adjustment of the location of each of the two extreme positions of the transfer support within the housing.

The stitchable material clamp member compressively engages the stitchable material during material transfer operations and is attached to the transfer support. In one embodiment, this clamp member includes a high friction engagement member to provide for an effective interface between the stitchable material clamp member and the stitchable material. This high friction engagement member may be positioned within an aperture (e.g., through which the sewing needle passes during sewing operations and through which a material cutting device passes during material cutting operations) of the clamp member, may extend below the clamp member to provide a high friction engaging surface for interaction with the stitchable material, and may itself define an aperture for the above-noted purposes.

A material transfer assembly generally of the above-described typed may be used to automate sewing and material cutting operations. In order to facilitate this use, the material transfer assembly preferably includes the above-noted bottom feed plate which is again fixedly interconnected with the arch clamp and which includes two displaced holes, one of which would be in the sewing area (where sewing operations are performed) and the other of which would be in the material cutting area (where material cutting operations are performed). In this case, the transfer support would move relative to both the bottom feed plate and arch clamp (both of which would typically be in a stationary position during movement of the transfer support in providing the material transport function). Since during at least a portion of this movement of the transfer support relative to the bottom feed plate the transfer support, via the stitchable material clamp member, is exerting a downward force on the bottom feed plate, preferably the bottom feed plate has a "reduced friction" upper surface. As such, the stitchable material clamp member, together with the transfer support, may effectively slide the stitchable material relative to and across the bottom feed plate.

DETAILED DESCRIPTION

A kit assembly 12 is initially described herein. Although the kit assembly 12 may be used with standard sewing machines such as the cam-driven pattern tacker sewing machine 500 discussed below in relation to FIGS. 20–28 (particularly in combination with the material transfer assembly 531), it is also advantageous when used in combination with a programmable sewing machine 16 of the type illustrated in FIG. 1 to provide fully automated buttonhole sewing operations. Moreover, although buttonholes are primarily described herein, it will be appreciated that other types of material removal or cutting operations may be appropriate for use of the kit assembly 12.

Figure 1:
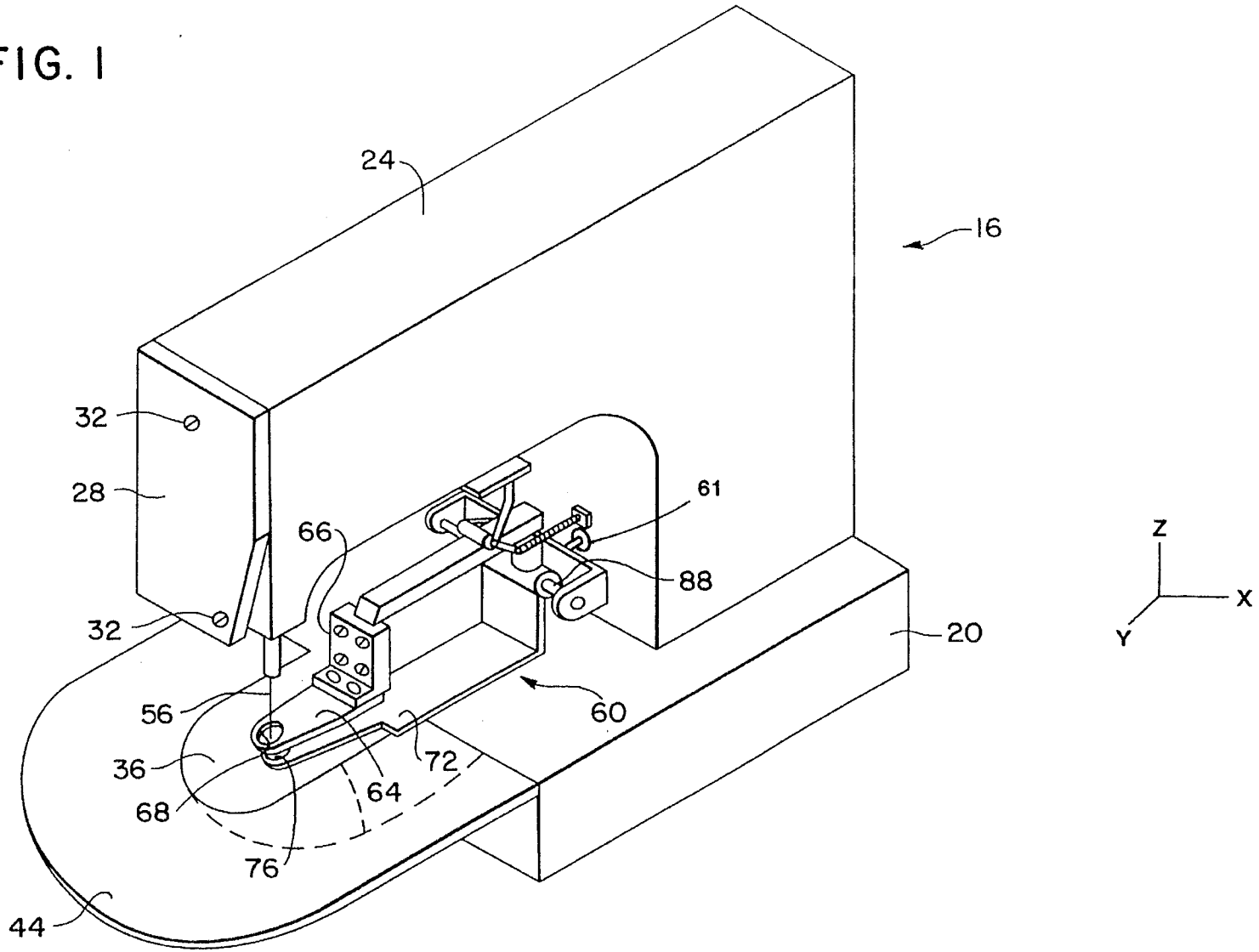
FIG. 1 is a perspective view of a known programmable sewing machine.

With reference primarily to FIG. 1, the programmable sewing machine 16 typically includes a base 20 which functions as a support, a head 24 which contains a portion of the sewing drive assembly 48 (FIG. 3), a detachable head cover 28 for accessing the sewing drive assembly 48 (FIG. 3), a cylinder bed or throat plate 36 which contains sewing components assembly 52 (FIGS. 3, 5, and 7) which interact with the sewing needle 56 to produce the desired stitch and which are positioned below the throat plate (e.g., a sewing area), a detachable support plate 44 which is positioned around the cylinder bed 36 to provide a surface for supporting the material to be stitched (FIG. 1), and a presser foot or arch clamp assembly 60 (FIG. 1) which moves the material to be stitched relative to the sewing needle 56 to produce the desired pattern. In order to produce this movement of the presser foot or arch clamp assembly 60, a programmable computer (not shown) governs control motors (not shown) which in turn direct the movement of the presser foot assembly 60 along and relative to the cylinder rod 88 (FIG. 2), inwardly and outwardly by an another extendable/retractable cylinder rod 61 which is substantially perpendicular to the rod 88 and which is fixedly attached to the support for the rod 88, and vertically via the illustrated linkages. Consequently, various stitching patterns may be stored in computer memory and accessed by the software to produce a preselected design.

Figure 2:
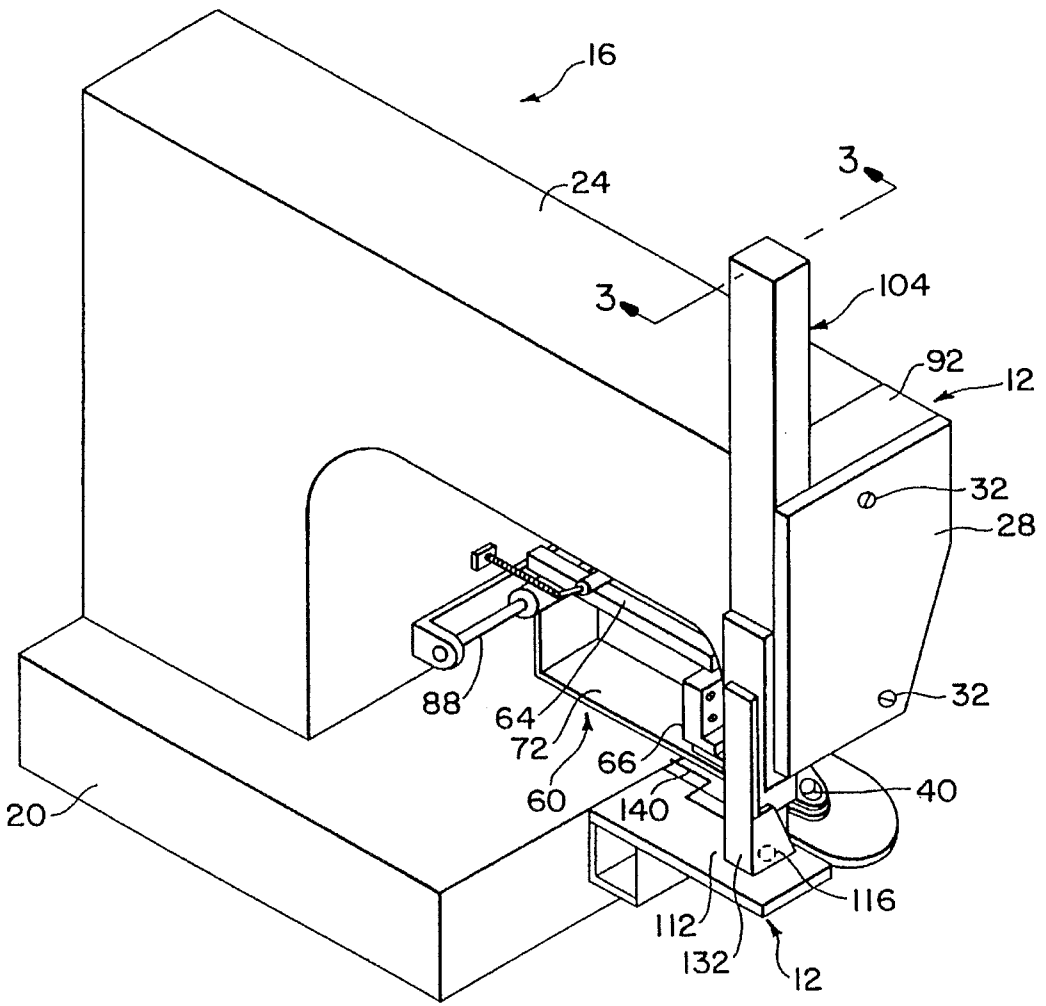
FIG. 2 is a perspective view of the programmable sewing machine of FIG. 1 incorporating a material removal unit to provide a material removal and sewing assembly.

One embodiment of the kit assembly 12 is illustrated in FIG. 2 as it would be typically attached to the programmable sewing machine 16 of FIG. 1, and thus forms a sewing and material removal assembly. The kit assembly 12 generally includes a support assembly 92 which is detachably connected to the end of the head 24 for containing the material removal device 120 (FIGS. 3–4), a driver 104 positioned above the head 24 which is coupled to and drives the material removal device 120, a table 112 which is detachably connected to the programmable sewing machine 16 substantially adjacent to and parallel with the cylinder bed 36, and a guard 132 which is pivotally attached to the support assembly 92 to protect against inadvertent dislodging of the material removal device 120 during sewing operations.

The support assembly 92 is configured to position the material removal device 120 contained therein so as to not interfere with the sewing drive assembly 48 or the sewing components assembly 52, including the sewing needle 56, of the programmable sewing machine 16. In one embodiment illustrated in FIGS. 3–4, a bore 96, positioned within the support assembly 92 and extending substantially vertically therethrough, guides the material removal device 120. This configuration reduces the deflection of the material removal device 120 when used on thicker and/or more resilient stitchable materials 144. In order to provide for a more frictionless engagement between the material removal device 120 and the bore 96, a sleeve bearing 100 of the type well known in the art is positioned therebetween.

The material removal device 120 generally includes a shaft 124, positioned within the bore 96 and coupled with the driver shaft 108 of the driver 104 by methods such as threaded engagement, and a cutting head 128 which removes stitchable material 144 to produce an opening of a desired contour. As can be appreciated, the cutting head 128 may be alternately configured to produce various contours of openings. Furthermore, the cutting head 128 may be a punch, cutting tool or any other suitable device for removing material. Although the shaft 124 and the cutting head 128 of the material removal device 120 may be integrally formed, the cutting head 128 in one embodiment is detachably connected to the shaft 124 by methods such as threaded engagement.

Figure 3:
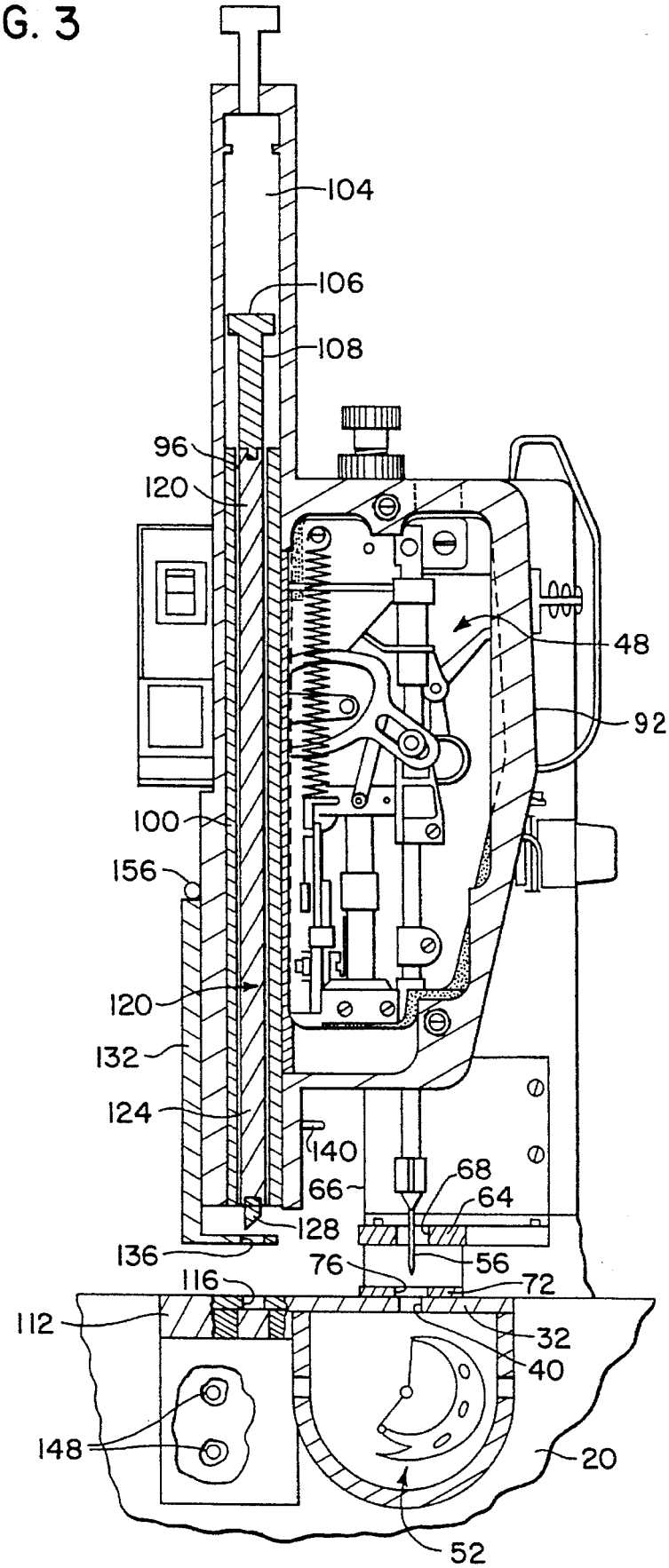
FIG. 3 is a cross-sectional view of the material removal unit of FIG. 2 taken along line 3—3.
Figure 4:
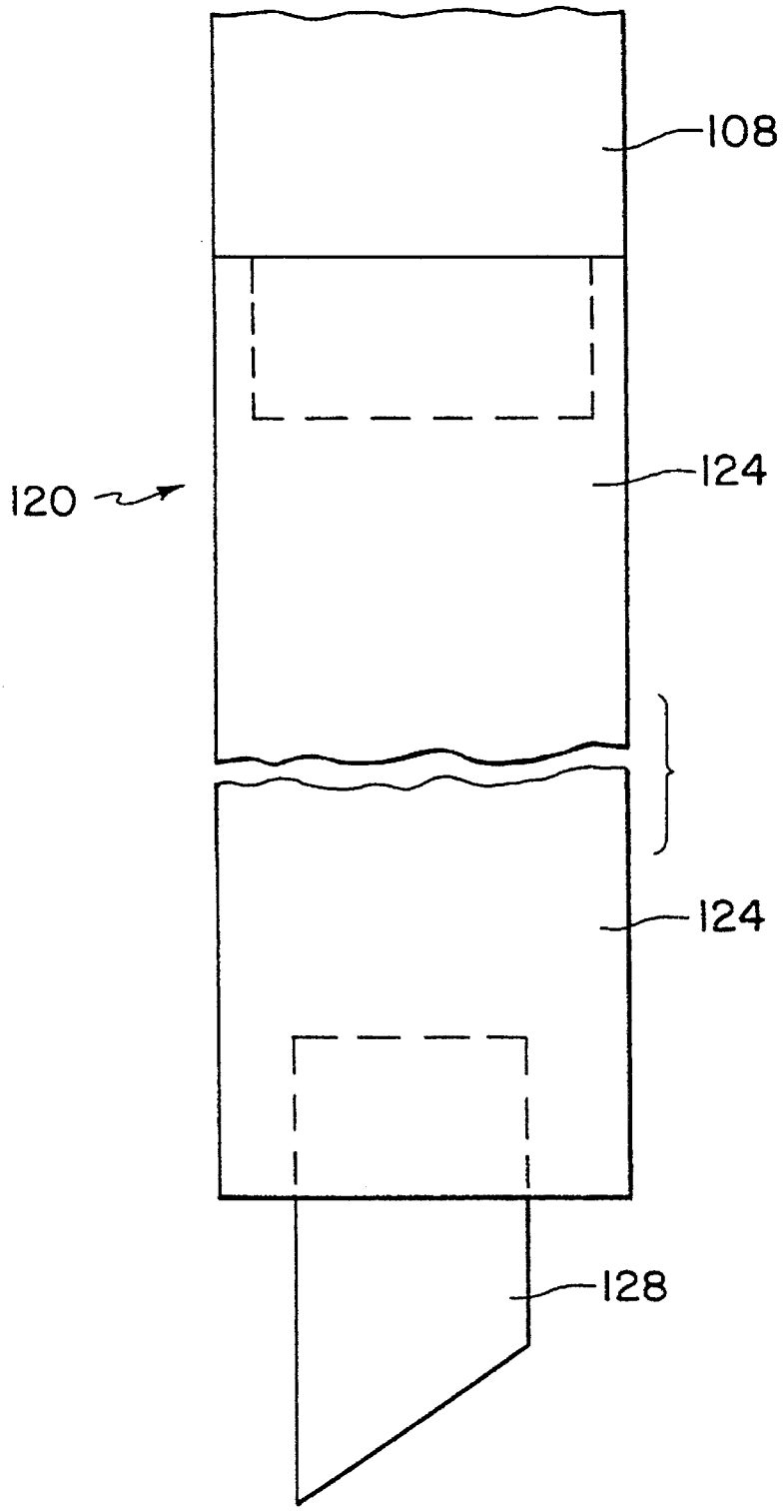
FIG. 4 is an enlarged view of one embodiment of a material removal device and its detachable connections.

The material removal device 120 is coupled with the driver 104 which supplies the necessary driving forces for material removal operations as best illustrated in FIGS. 3–4.

Although numerous types of drivers 104 may be used and placed in a variety of positions, in one embodiment the driver is an air cylinder which is positioned above the head 24 and driven by an appropriate source (not shown). This positioning is advantageous in that a larger capacity driver 104, in this case an air cylinder having a driver piston 106 and driver shaft 108, may be used (i.e., more force application capacity) without interfering with the sewing drive assembly 48 or the sewing components assembly 52.

Figure 5:
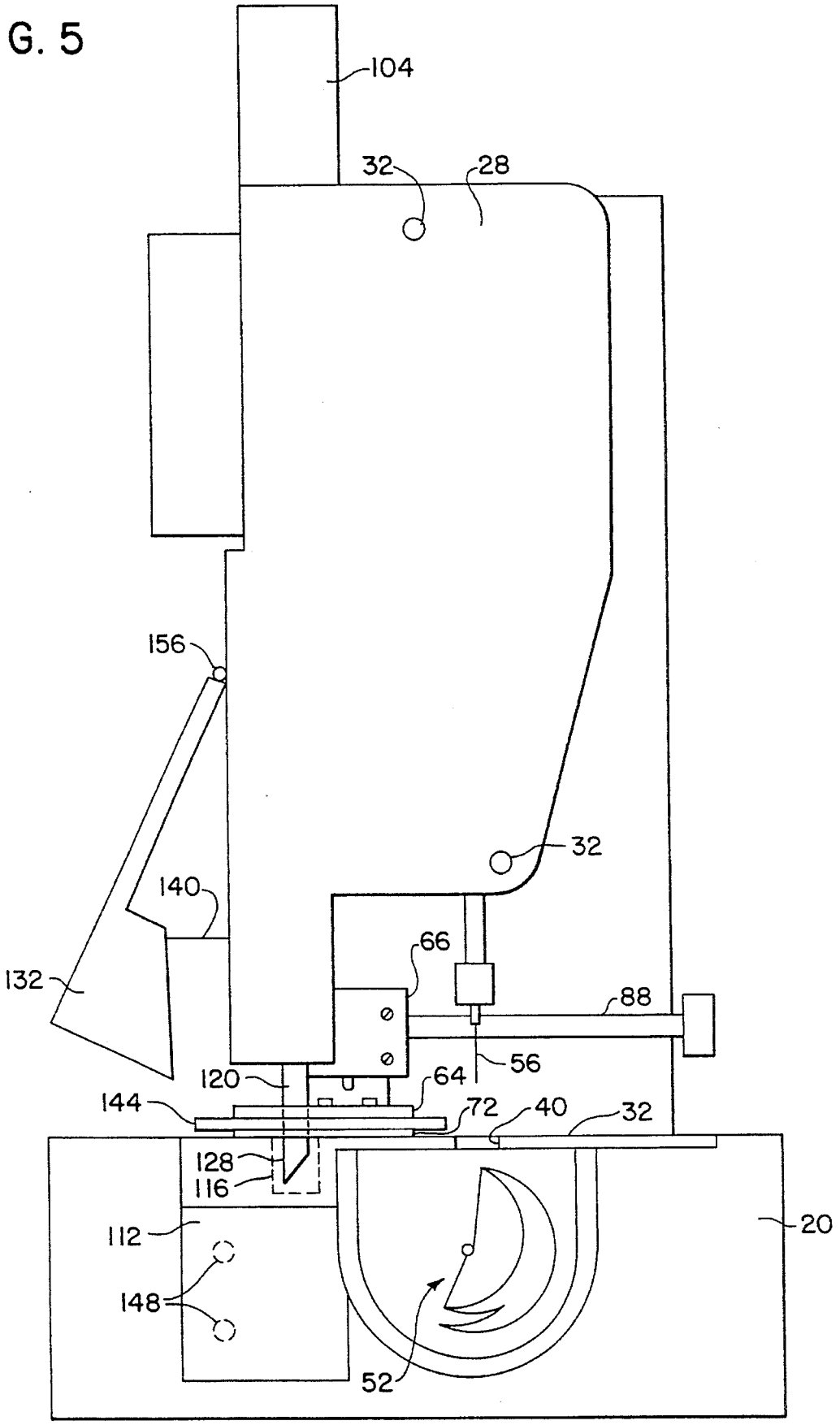
FIG. 5 is a front view of the assembly of FIG. 2, illustrating the positioning of the presser foot assembly and guard during material removal operations.
Figure 6:
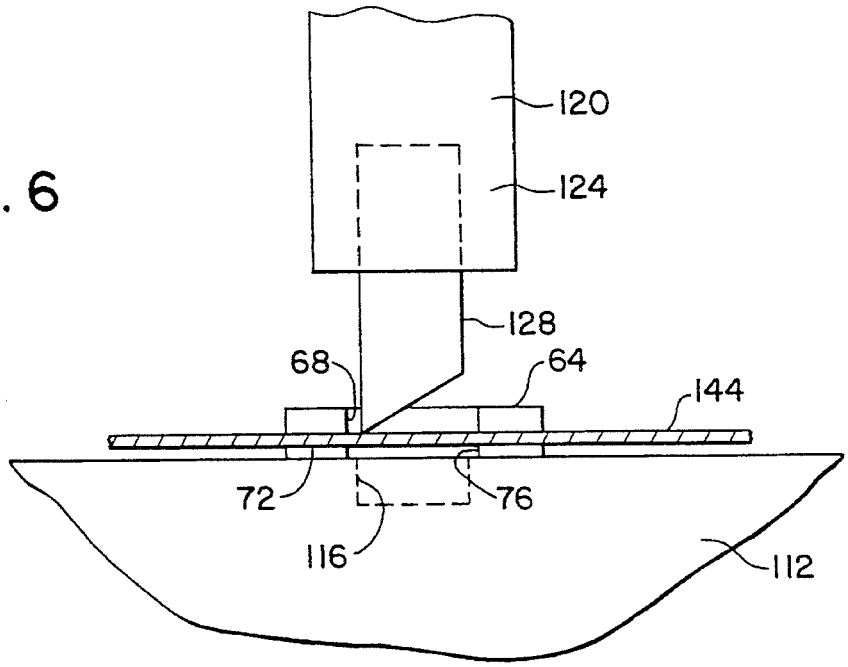
FIG. 6 is an enlarged front view of one embodiment of a material removal device during material removal operations.
Figure 8:
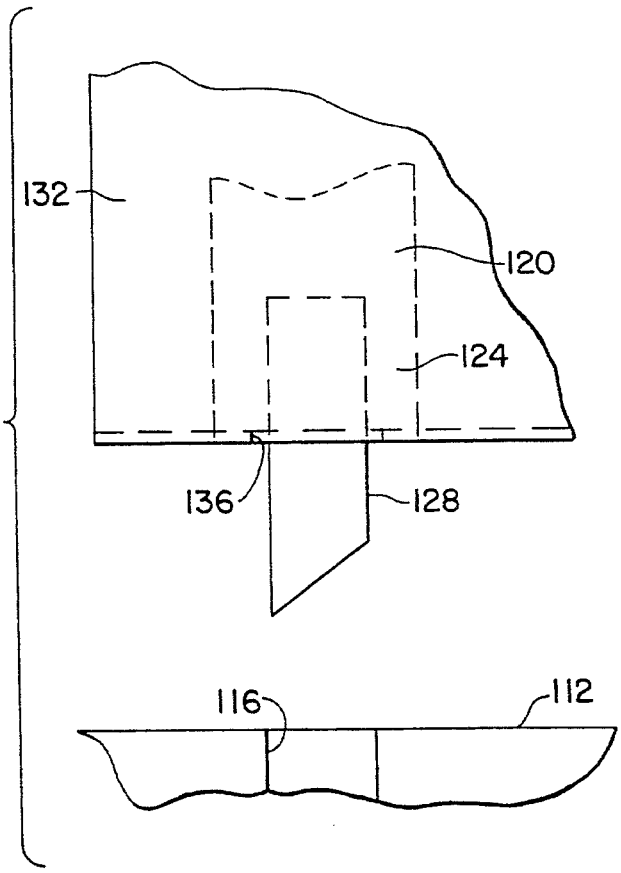
FIG. 8 is an enlarged front view illustrating the restricting of the downward movement of one embodiment of a material removal device by the guard.
Figure 7:
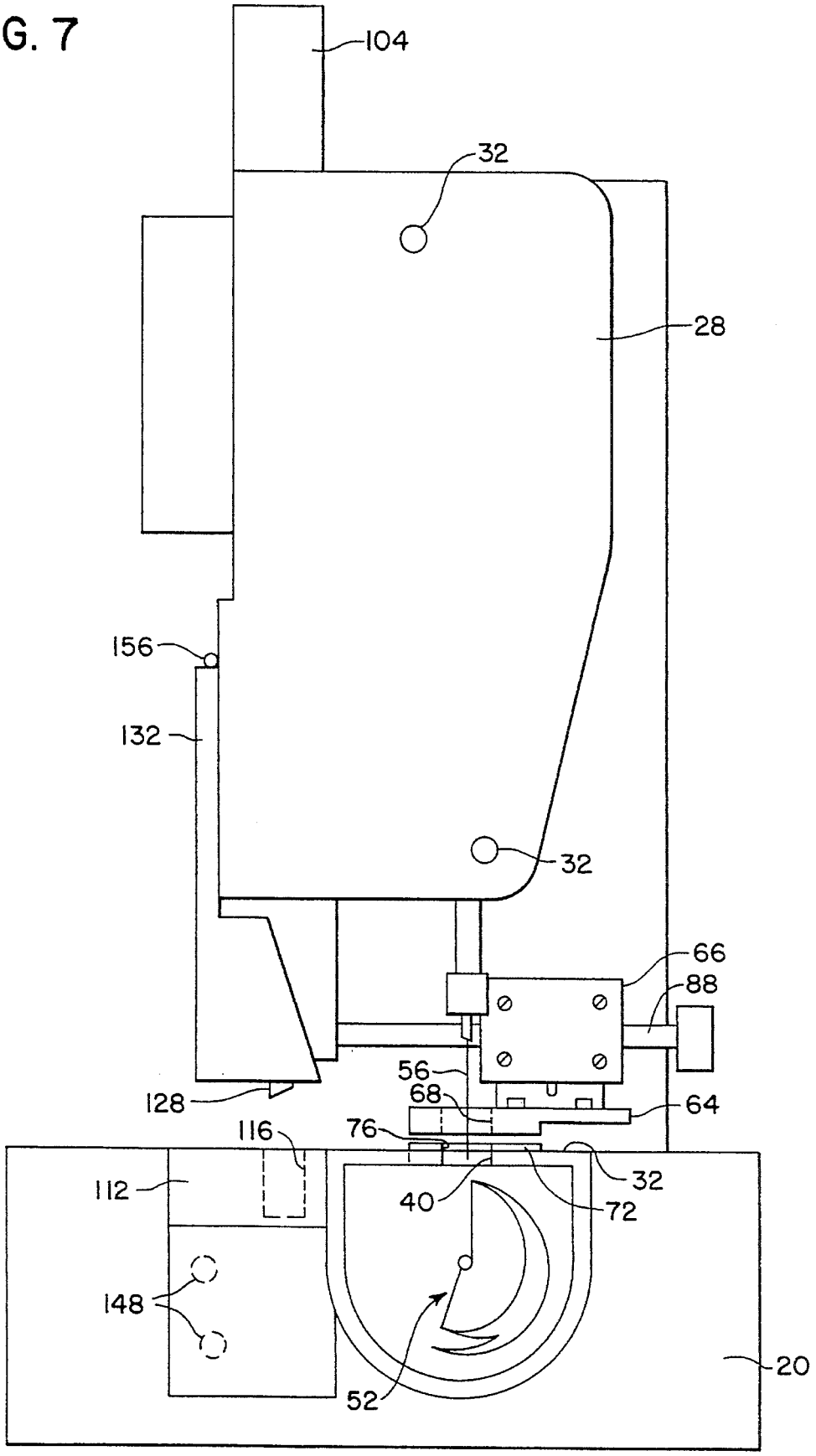
FIG. 7 is a front view of the assembly of FIG. 2, illustrating the positioning of the presser foot assembly and guard during sewing operations.
Figure 10:
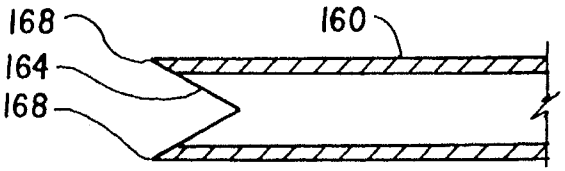
FIG. 10 is a cross-sectional view of the material removal device of FIG. 9 taken along line 10—10.
Figure 9:
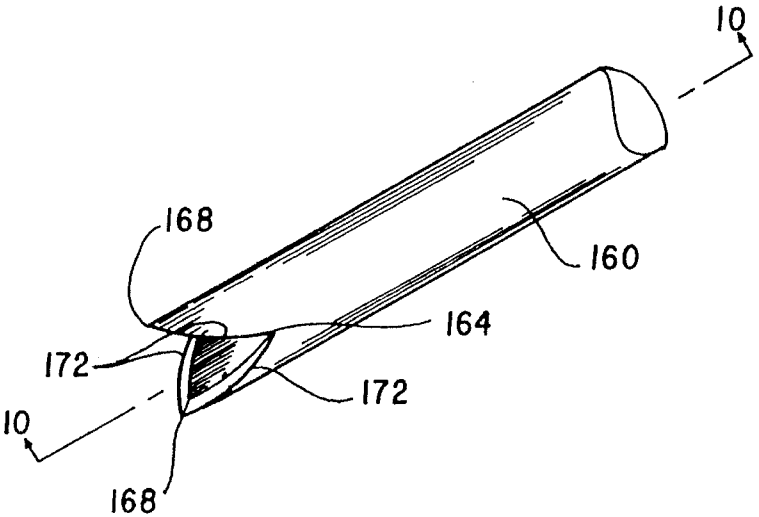
FIG. 9 is a perspective view of one embodiment of a hollow material removal device.

For purposes of enhancing operator safety during buttonhole sewing operations, a shelter or guard 132 is suitably attached to the support assembly 92, typically by a pivotal connection 156, as illustrated in FIGS. 3, 5, and 7. When the presser foot assembly 60 of the programmable sewing machine 16 is repositioned to the material removal area (FIG. 5) by the software and control motors (not shown), the bracket 66 of the presser foot assembly 60 engages with a guard wire 140 (FIGS. 2–3) attached to the guard 132 which pivots the guard 132 away from the area through which the material removal device 120 travels so that material removal operations may be performed. However, when the presser foot assembly 60 moves to the position illustrated in FIG. 7 to perform sewing operations, the guard 132 pivots to a position around and below which the material removal device 120 normally travels to restrict its downward movement in the event it is inadvertently deployed. In this regard, the cutting head 128 may pass through a guard hole 136 on the bottom of the guard 132 so that it is not damaged, as best illustrated in FIG. 8. However, the shaft 124 of the material removal device 120 is of a larger diameter than the guard hole 136 and thus inhibits further downward movement of the material removal device 120.

In order to provide a suitable surface for the material removal device 120 to engage with during material removal operations, the support plate 44 (FIG. 1) is replaced with a table 112 (FIG. 2) which is detachably connected to the programmable sewing machine 16 in a position which is substantially adjacent to and parallel with the cylinder bed 36. However, the table 112 is isolated from the sewing area below the cylinder bed 36 by the casting of the sewing machine 16. Positioned within the table 112, as best illustrated in FIGS. 3, 5, and 6–8, is a recessed receiver 116 in which the cutting head 128 of the material removal device 120 enters after having fully passed through the stitchable material 144. In order to enhance cutting of the stitchable material 144, the upper portion of the receiver 116 may be contoured to provide a cutting edge.

An advantage of the structural configuration of the kit assembly 12 presented herein is that it is positioned a sufficient distance from the sewing drive assembly 48 and the sewing components assembly 52, including the sewing needle 56, so as to not interfere with their normal operations. Nonetheless, the kit assembly 12 may be positioned sufficiently close to the sewing area defined by the cylinder bed 36, more particularly the sewing needle 56 and the cylinder bed hole 40, so as to not adversely affect the overall speed of the material removal and sewing operations. In this regard and for a buttonhole application, preferably the distance between the centers of the recessed receiver 116 and the cylinder bed hole 40 will be about five (5) inches or less.

Installation of the kit assembly 12 typically requires little if any modification of the programmable sewing machine 16. When used with a programmable sewing machine of the type illustrated in FIG. 1, the head cover 28 is detached by removing the head cover screws 32 and the support assembly 92, which preferably is configured to substantially follow the contour of the end of the head 24, is mounted to the head 24. The head cover 28 may then be positioned on the end of the support assembly 92 and the head cover screws 32, or appropriate substitutes, may be positioned through the holes in the head cover 28, the support assembly 92, and programmable sewing machine 16. In order to complete the installation, the support plate 44 is removed and the table 112 is positioned substantially adjacent to and parallel with the cylinder bed 36 and is attached to the programmable sewing machine 16 in an appropriate manner by, for instance, two fasteners 148 (FIG. 3). Although material removal operations may be manually controlled, preferably the kit assembly 12 is integrated with the software of the programmable sewing machine 16 such that fully automated operations will be provided.

When the kit assembly 12 has been properly integrated with the controlling software for the programmable sewing machine 16 and material removal operations are to be initiated, the stitchable material is placed in the presser foot assembly 60 of the programmable sewing machine 16 between the upper presser foot or arch clamp 64 and the lower presser foot or bottom feed plate 72. Thereafter, the presser foot assembly 60 is engaged as is known in the art to firmly secure the stitchable material 144. Then the presser foot assembly 60, together with the stitchable material 144, is moved to the desired position for material removal operations as generally illustrated in FIG. 5. As the presser foot assembly 60 is repositioned over the table 112, the bracket 66 engages the guard wire 140 attached to the punch guard 132 such that it pivots away from the support assembly 92 into the position illustrated in FIG. 5.

Once the desired sewing pattern has been selected, the software sends a signal to the driver 104 to activate the material removal device 120. Consequently, the material removal device 120 is driven down through the upper and lower presser foot holes 68, 76, respectively, and the stitchable material 144 until the cutting head 128 enters the receiver 116 in the table 112. After the desired portion of the stitchable material 144 has been removed, the software directs the controllers (not shown) to retract the driver shaft 108 of the driver 104 and thus the material removal device 120.

After the material removal operations are completed, the presser foot assembly 60, as directed by the software and through use of the control motors (not shown), is moved laterally toward the cylinder bed 36 along the cylinder rod 88 to align the opening in the stitchable material 144 with the sewing needle 56. During this movement of the presser foot assembly 60, the guard 132 moves into the position illustrated in FIG. 7 since the bracket 66 of the presser foot assembly 60 no longer exerts a force on the guard wire 140. When the stitchable material 144 is properly positioned relative to the sewing needle 56, the software directs the sewing drive assembly 48 to begin sewing operations through the sewing components assembly 52, including the sewing needle 56, as is well known in the art. Consequently, a pattern is sewn around and in the opening in the desired manner.

Once sewing operations are completed, the software directs the controllers (not shown) to move the presser foot assembly 60, together with the stitchable material 144, in a lateral direction along the cylinder rod 88 from the position illustrated in FIG. 7 back to the initial position generally illustrated in FIG. 5. When this movement is initiated, the sewing needle 56 is in an upward position as illustrated in FIG. 5 so as to not catch on the upper presser foot 64. Moreover, as the presser foot assembly 60 is repositioned over the table 112, the bracket 66 engages the guard wire 140 attached to the guard 132 such that it pivots away from the support assembly 92 into the position illustrated in FIG. 5 to allow material removal operations to be performed. Thereafter, the cycle of material removal and sewing operations may be repeated in the above-described manner.

Although the material removal and sewing operations has been described as such, it can be appreciated that the sequence may be reversed. In this regard, the sewing operations would first produce the desired stitching pattern on the stitchable material 144. Thereafter, material removal operations would be performed to remove portions of the stitchable material 144 inside of the area defined by the stitching pattern. Although the same general end product is obtained by both sequences, performing material removal operations after sewing operations results in a hole or opening not having a stitched border therearound, thereby exposing some fibers of the stitchable material 144.

As can be appreciated by those skilled in the art, after material removal and sewing operations are completed, the punch kit assembly 12 of may be disabled or entirely removed such that the programmable sewing machine 16 may be used for alternate functions. This is desirable since most programmable sewing machines are used for industrial applications and thus are quite expensive. Moreover, essentially no structural modification is required of the programmable sewing machine 16 to use the kit assembly 12 so that performance of the programmable sewing machine 16 is not adversely affected. Furthermore, material removal operations may take place sufficiently close to the sewing area in the case of the kit assembly 12 such that the overall speed of material removal and sewing operations is not adversely affected.

Figure 14:
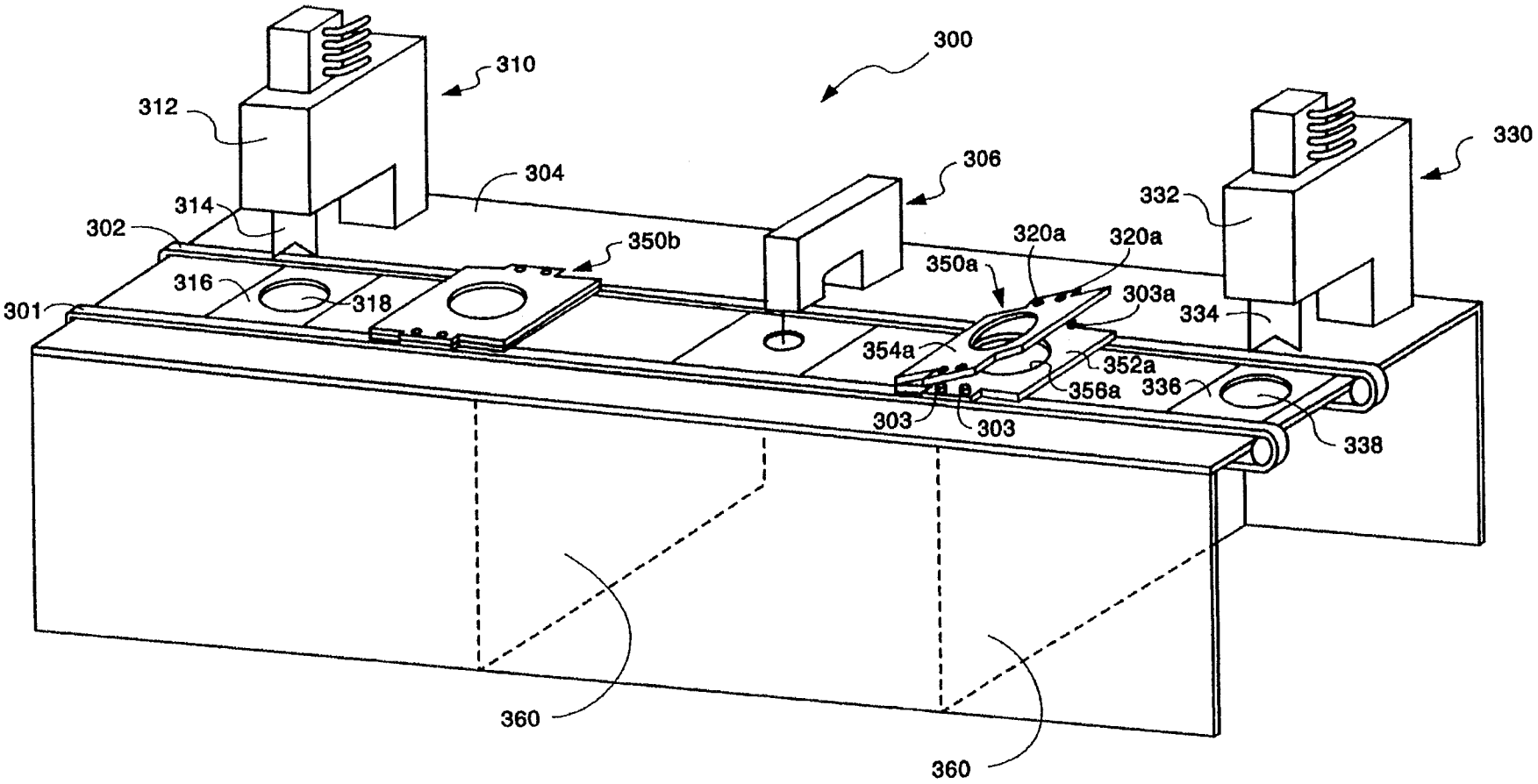
FIG. 14 is a perspective view of another embodiment of a sewing and material removal assembly.
Figure 15:
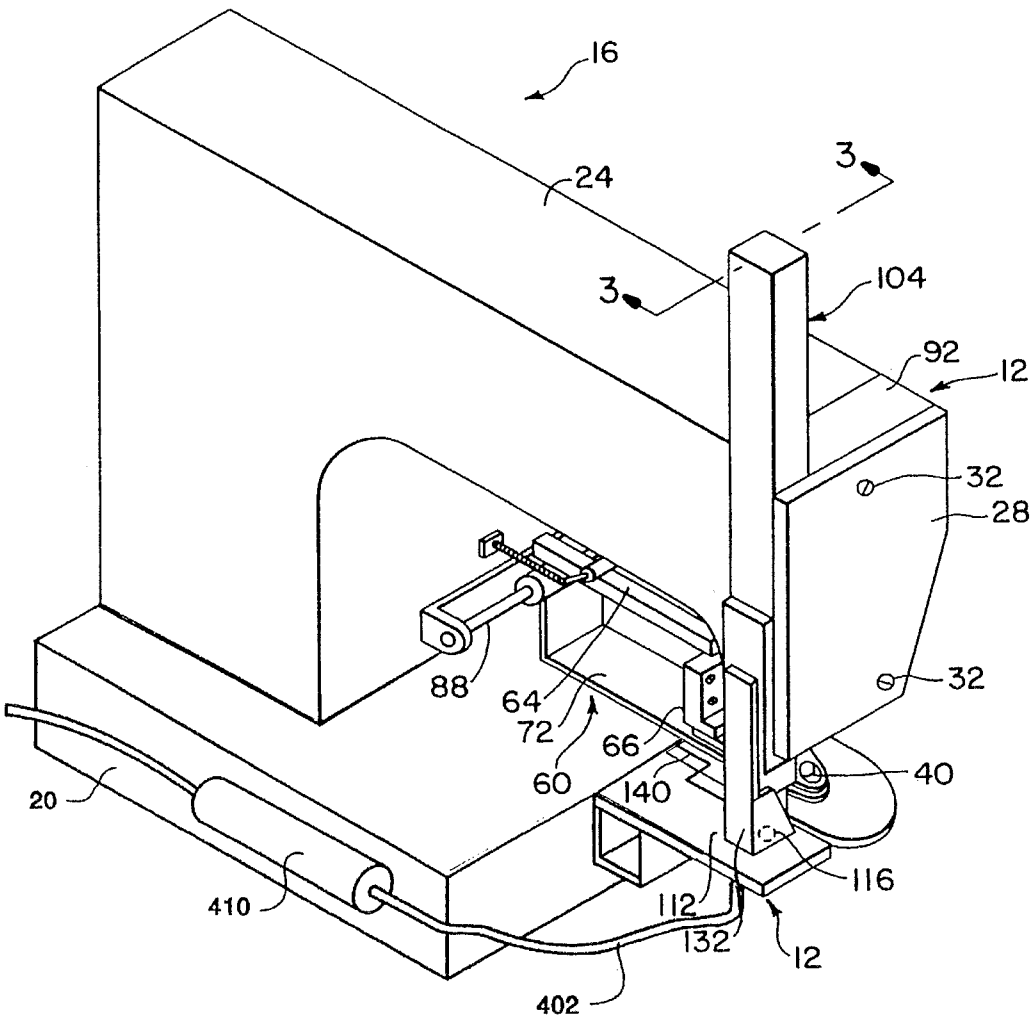
FIG. 15 is a perspective view of the assembly of FIG. 2 incorporating an alignment assembly.

Another material removal and sewing assembly is illustrated in FIG. 14. Generally, the material removal and sewing assembly 300 includes a first material removal unit 310 and a second material removal unit 330 which are laterally displaced on opposing sides of a sewing unit 306. The sewing unit 306 provides for sewing operations on one or more pieces of stitchable material (e.g., one or more overlapping plies), whereas each of the material removal units 310, 330 provide for material removal operations on such stitchable material. A transport assembly belt 302 integrates sewing and material removal operations by moving pallet clamps 350*a*, 350*b* along platform 304 between sewing unit 306 and material removal units 310, 330. Consequently, the transport assembly 302 also interconnects the sewing unit 306 with each of the material removal units 310, 330.

As in the case of the kit assembly 12 mounted on the programmable sewing machine 16, the material removal operations are again isolated from the sewing area. This may be provided by barriers 360 disposed on opposite sides of the sewing unit 306. Alternatively, the sewing unit 306 and each of the material removal units 310, 330 may each be contained within separate housings (not shown). In this case, there would be three physically separate machines (i.e., a sewing unit and two material removal units) which would then be appropriately interconnected to provide an assembly 300 with an automated integration of sewing and material removal operations. For instance, the platform 304 could be positioned on the upper surface of these separate machines and appropriately attached thereto, and the platform 304 could incorporate the transport assembly 302.

As noted, the assembly 300 has the sewing unit 306, although more could be incorporated if desired to further enhance production capabilities. Nonetheless, the sewing unit 306 is preferably a programmable sewing machine analogous to the machine discussed above, and thus is able to provide automated sewing operations for the assembly 300. Moreover, each material removal unit 310, 330 is principally similar to the kit assembly 12 discussed above for providing automated material removal operations for the assembly 300. However, the spacing between the sewing unit 306 and each of the material removal units 310, 330 is increased over that disclosed above with regard to the kit assembly 12 to accommodate, for instance, for different applications.

The first and second material removal units 310, 330, respectively, include a head 312, 332, respectively, which houses a material removal device or punch 314, 334, respectively, for removing portions of stitchable material from a given work-piece in a predetermined pattern. Each punch 314, 334 is preferably threadedly engaged with the respective material removal unit 310, 330 or otherwise detachable therefrom to allow punches of different sizes and geometric configurations to be used with the material removal units 310, 330. It will be appreciated that a plurality of punches may be utilized by each material removal unit 310, 330 (not shown), for instance, to punch a predetermined pattern of a plurality of holes in one or more pieces of stitchable material. Regardless if one or more punches are used, such may be driven in the above-described manner, either individually or via mounting on a common structure which is then appropriately driven.

Each material device 310, 330 also includes a removable punch table 316, 336 having a bore 318, 338 positioned beneath punch 314,334 to receive a portion of punch 314, 334 during a punching operation. The diameter of each bore 318, 338 is preferably slightly larger than the outer diameter of punch 314,334 to allow a portion of the associated punch 314, 334 to pass through the bore 318, 338 during a material removal operation. As will be appreciated, punch tables 316, 336 having bores of different sizes and configurations may be required to accommodate punches 314, 334 of different sizes and shapes. Moreover and in the case where multiple punches are used to produce a predetermined pattern of a plurality of holes in one or more pieces of stitchable material, multiple bores may be utilized with one being aligned with each associated punch.

The transport assembly 302 transfers the stitchable material between the material removal units 310, 330 and the sewing unit 306. The transport assembly 302 includes a conveyor belt 301 and pallet clamps 350. Each pallet clamp 350 includes a lower member 352 and an upper member 354 for retaining one or more overlapping pieces of stitchable material therebetween. In order to appropriately interconnect the conveyor belt 301 and the pallet clamps 350, the conveyor belt 301 includes pegs 303 which pass through positioning holes 320 in the upper members 352 and lower members 354 of the pallet clamps 350.

The pallet clamps 350 retain the one or more pieces of stitchable material during material removal and sewing operations, and also allow for an automated transfer of such materials between the sewing unit 306 and the material removal units 310, 330. In this regard, each pallet clamp 350 further includes a bore 356. This bore 356 allows a punch(es) from one of the material removal units 310, 330 to pass through the pallet clamp 350 and thus perform material removal operations on the one or more pieces of stitchable material therein, as well as allows the sewing needle of the sewing unit 306 to perform sewing operations on such one or more pieces of stitchable material while positioned in the pallet clamp 350. As will be appreciated, pallet clamps 350 having differently sized and shaped bores may be used with punches of different sizes and shapes.

The sewing and material removal assembly 300 provides for a desired automation of sewing and material removal operations and with an increased production capacity. That is, the sewing unit 306 alternately receives materials from the material removal units 310, 330 for performing sewing operations thereon. One such sequence which could be used is as follows. Initially, with the conveyor belt 301 in the position illustrated in FIG. 14 and while in a stationary condition, the operator (not shown) unloads the one or more pieces of stitchable material from the pallet clamp 350*a* after sewing and material removal operations have been performed thereon. The pallet clamp 350*b* has one or more pieces of stitchable material positioned thereon (not shown) and has already had material removal operations performed thereon at the material removal unit 310. The operator places one more pieces of stitchable material in the pallet clamp 350*a*. More specifically, one or more pieces of stitchable material are positioned on the lower member 352*a* of the pallet clamp 350*a* and its upper member 354*a* is then closed over the lower member 352*a* to secure the one or more pieces of stitchable material in place. Thereafter, the operator may initiate a cycle by providing a signal to the assembly 300 which causes the conveyor belt 301 to moves the pallet clamp 350*a* under the material removal unit 330 and to simultaneously move the pallet clamp 350*b* under the sewing unit 306. After the material removal device 330 and sewing machine 306 have completed their respective operations on the materials in the pallet clamps 350*a*, 350*b*, respectively, the controlling software moves the conveyor belt 301 back to the position illustrated in FIG. 14 at which time the one or more pieces of stitchable material from the pallet clamp 350*b* are removed therefrom (having one or more holes formed therein with an associated sewing pattern), and one or more pieces of new stitchable material are loaded in the pallet clamp 350*b* in the above-described manner. The pallet clamp 350*a* remains in this position with its stitchable material being retained therein. The above sequence is then repeated, namely the stitchable material in the pallet clamp 350*a* and with one or more holes formed thereon is provided to the sewing unit 306 for the performance of sewing operations thereon, while the pallet clamp 350*b* is disposed in alignment with the material removal unit 310 for performance of material removal operations thereon. Although the sewing and material removal sequence has been described as such, those skilled in the art will appreciate that the sequence and/or the timing thereof may be modified. For instance, once the cycle is initiated the conveyor belt 301 may stall for a predetermined period of time in the position illustrated in FIG. 14 to allow a given pallet clamp 350 to be unloaded with a finished product and reloaded with new stitchable materials. Moreover, although the assembly 300 has been described with regard to two material units 310, 330 which alternately feed a common sewing unit 306, such is not required for all aspects of the present invention.

Further aspects of the material removal operation are illustrated in FIGS. 9–13, which specifically disclose an embodiment for efficiently removing material portions of a stitchable material and then carrying away and preferably disposing of such removed portions. As can be appreciated, when removing material portions of heavy-duty stitchable materials (e.g., multiple plies, thicker materials, resilient materials), an increased amount of force may be required to drive the material removal device 120 discussed above through such materials, particularly if the portion of the cutting head 128 of the material removal device 120 which interacts with the stitchable material is a substantially continuous planar surface (e.g., a blunt-nosed configuration). Consequently, the material removal device 160 of FIGS. 9–10 utilizes a hollow configuration which reduces the area of contact between the stitchable material and the material removal device 160 to effectively an edge, thereby providing for an enhanced "cutting" action and more efficient penetration.

The material removal device 160 utilizes a hollow tubular configuration and V-shaped portions 164 are positioned on opposite sides of the device 160 such that there are two points 168 which first engage the stitchable material for a more effective initial separation thereof. Moreover, the V-shaped portions 164 define four cutting edges 172 (only three shown) which taper outwardly from the points 168 to further enhance the separation of the stitchable material as the material removal device 160 is driven downwardly through the stitchable material. Although the material removal device 160 may be formed from a variety of materials, preferably the device 160 is metal which improves its durability and allows for the provision of sharp cutting edges 172. Moreover, as can be appreciated the diameter and/or end configuration of the hollow material removal device 160 may be varied depending upon criteria such as the given applications requirements. For instance, the material removal device 160 is substantially circular with an outside diameter ranging from about ⅛ inch to about ¼ inch.

Figure 11:
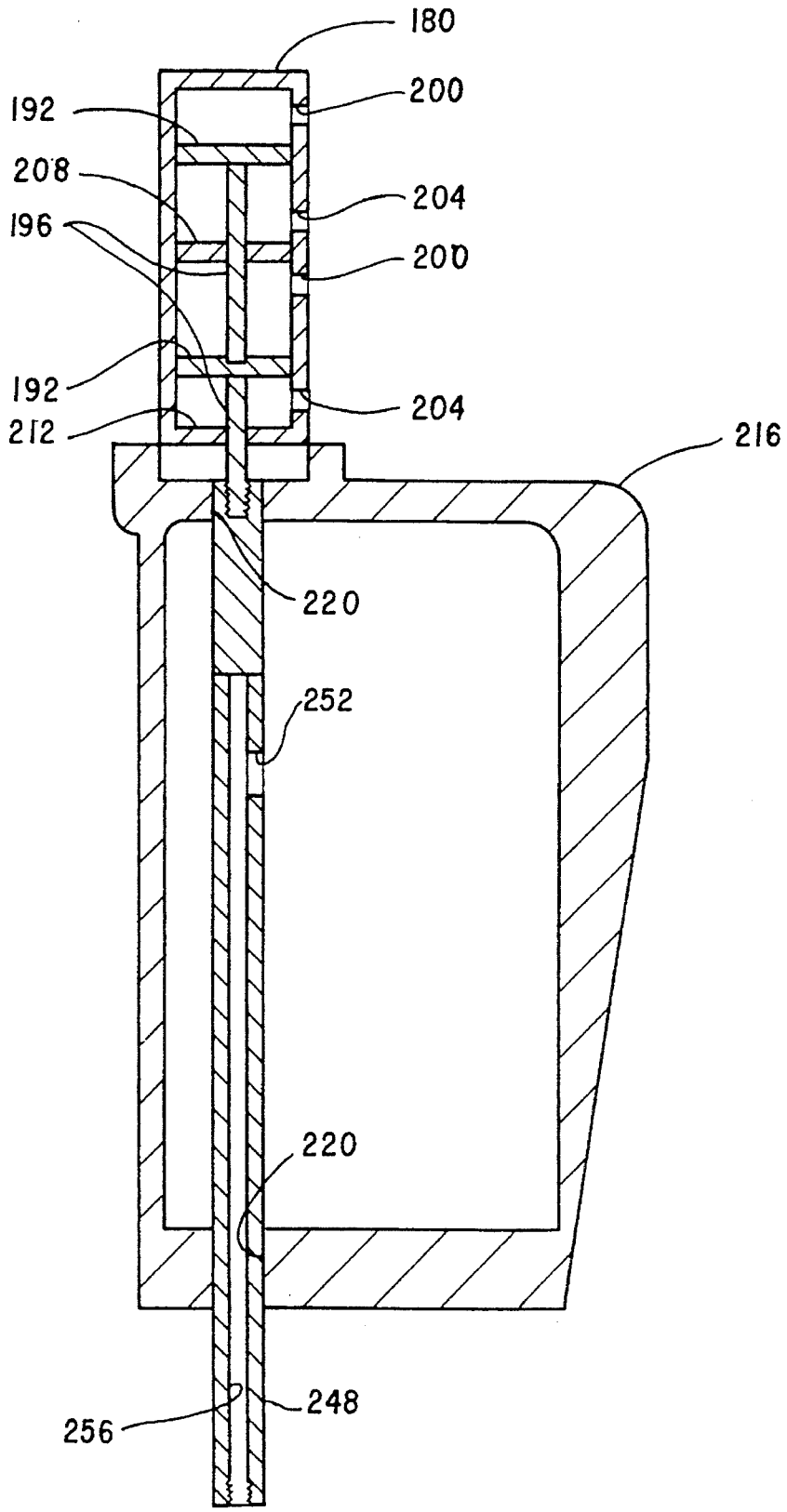
FIG. 11 is a cross-sectional view of one embodiment of a drive assembly for material removal operations which utilizes a system for carrying away the removed portions.

The material removal device 160 is driven downwardly into engagement with the stitchable material to remove material portions thereof. Although a number of drive mechanisms for performing this function would be appropriate, FIG. 11 illustrates a drive assembly 180 which is particularly suitable based upon the portion disposal system 244 which is preferably used with the material removal device 160 as will be discussed below.

The drive assembly 180 is appropriately mounted on a support assembly 216. The support assembly 216 preferably approximates the contour of an end portion of the head 24 of the programmable sewing machine 16 (FIG. 1) such that the assembly 216 may be attached thereto in a manner similar to support assembly 92 discussed above. The drive assembly 180 utilizes two chambers 188 in a "series" configuration (i.e., stacked), the chambers 188 being separated by a partition 208. Each chamber 188 has a piston 192 slidably positioned therein with a piston shaft 196 being attached to each of the pistons 192 to transfer the motion of such pistons 192 to a desired object. In this regard, the uppermost piston shaft 196 extends through the partition 208 and engages the lowermost piston 192 in an appropriate manner. The piston shaft 196 of the lowermost piston 192 extends through the bottom 212 of the drive assembly 180 to engage the connecting shaft 248 which is used to transfer the motion of the pistons 192 to the material removal device 160. Consequently, the pistons 192 and thus the piston shafts 196 are capable of simultaneous movement to govern movement of the material removal device 160.

The drive assembly 180 is a dual action configuration in that each chamber 188 has an upper and lower port 200, 204. Consequently, conduits (not shown) may be connected to the upper and lower ports 200, 204 to supply a medium to alternately act against the opposite sides of the pistons 192 at the appropriate times and thus achieve the desired downward and upward motion for the material removal device 160. Although various mediums may be employed, preferably a pneumatic system (not shown) is utilized for driving the pistons 192 through this downward/upward cyclic motion.

The simultaneous movement of the pistons 192 is transferred to the connecting shaft 248 which has the material removal device 160 attached at its opposite end. The lowermost piston shaft 196 may engage the upper end of the shaft 248 by various appropriate manners, such as threaded engagement. The material removal device 160 may also be similarly attached to the lower end of the shaft 248. In order to stabilize the connecting shaft 248 and limit the deflection thereof when engaged in material removal operations, the shaft 248 and/or the lowermost piston shaft 192 pass through a bore 220 in the upper and lower portions of the support assembly 216. Although not shown, a sleeve bearing may again be utilized in the bores 220 to reduce the frictional engagement of the shaft 248 and/or piston shaft 196 with the support assembly 216.

Based upon the hollow configuration of the material removal device 160 and the downward direction in which the device 160 moves when removing portions of stitchable material, there may be a tendency for the removed portions to move up within the hollow interior of the device 160. After an extended period of operation, the potential for a plurality of such removed portions filling or becoming jammed within the entire interior portion of the material removal device 160 increases, which could adversely effect material removal operations. In order to reduce this potential, the material removal device 160 is preferably used in combination with the portion disposal system 244 illustrated in FIGS. 11 and 12.

The portion disposal system 244 carries away the removed portions of stitchable material. A portion of the disposal system 244 is incorporated within the drive assembly 180 discussed above in that the connecting shaft 248, which is again used to transfer the motion of the pistons 192 to the material removal device 160, has an inner cavity 256 which extends along a portion of the length of the shaft 248 and which is in communication with the hollow interior of the material removal device 160. A port 252 extends through a wall of the shaft 248 in an appropriate location to interact with this cavity 256. Consequently, an appropriate conduit (not shown) may be positioned within the port 252 such that an appropriate medium may be forced through the inner cavity 256 to discharge the removed material portions from the end of the material removal device 160 at the appropriate time. As can be appreciated, such removed portions could also be withdrawn from the interior of the hollow material removal device 160 by a suction-type action.

Figure 12:
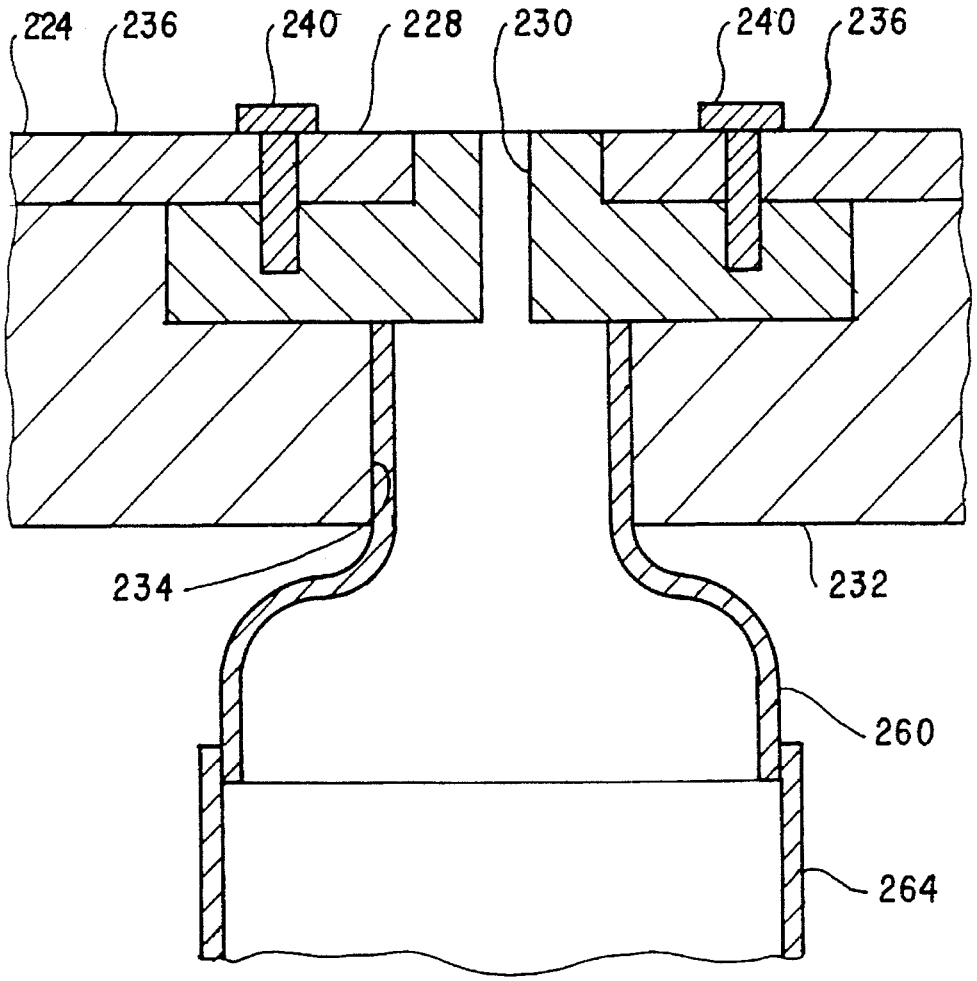
FIG. 12 is one embodiment of a table for interacting with the material removal device and which incorporates a part of a portion disposal system.
Figure 13:
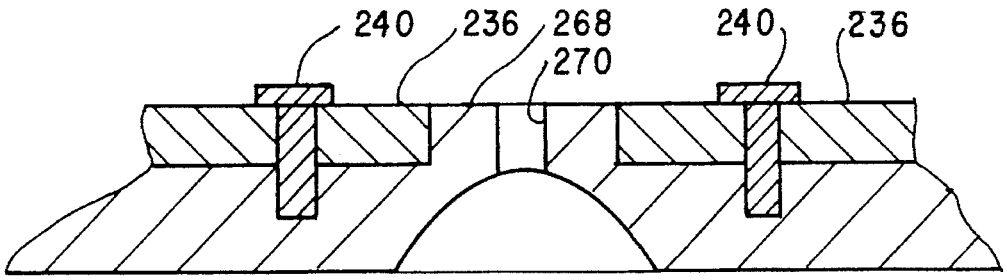
FIG. 13 is one embodiment of a table for interacting with a light duty material removal device.

In order to allow for the collection of the removed portions of stitchable material, the above-described table 112 and receiver 116 are modified. FIG. 12 illustrates the pertinent portions of the table 224 which accommodates for use of the portion disposal system 244, the remainder of the table 224 being substantially similar to the table 112 described above for similar attachment to the programmable sewing machine 16 (e.g., such that the table 224 is substantially parallel with and adjacent to the cylinder bed 36). The table 224 includes an insert 228 with a bore 230 therethrough such that the shaft 248 and the attached material removal device 160 may travel within the bore 230 during material removal operations. The insert 228 is seated within a base 232 and is secured therein by positioning plates 236 over portions of the insert 228 and by engaging the plates 236, insert 228, and base 232 with screws 240.

A bore 234 within the base 232 is substantially aligned with the bore 230 in the insert 228. A bell-shaped adapter 260 is positioned and secured within the bore 234, such as by threaded engagement, in order to interconnect the bore 234 and a conduit 264 attached to the adapter 260. The removed portions of stitchable material may therefore ultimately flow through the conduit 264 and be appropriately deposited. In this regard, the opposite end of the conduit 264 is preferably connected to an appropriate receptacle (not shown) which will contain the removed portions of stitchable material. Based upon the preferred medium used by the portion disposal system 244, namely forced air, this receptacle is preferably formed from a material which will allow the medium to pass therethrough but which will retain the portions of stitchable materials, such as a cotton receptacle.

In summarizing the operation of the material removal operations when the material removal device 160 is used in combination with the portion disposal system 244, the pistons 192 of the drive assembly 180 will be in their uppermost positions within the respective chambers 188 prior to initiation of the removal operations. When the stitchable material has been properly positioned for removal operations in the above-described manner, the medium, again preferably air, is provided through the upper ports 200 of the chambers 188 to drive the pistons 192 in a downward direction. Consequently, the shaft 248 and material removal device 160 are also driven in a downward direction such that the material removal device 160 penetrates and passes through the stitchable material to remove material portions thereof. As a result, the material removal device 160 enters the bore 230 of the insert 228.

As can be appreciated, when heavy duty stitchable materials are being subjected to the above-described material removal operations, particularly when relatively thick materials are being used, it may be necessary for the length of the bore 230 to be sufficiently long since there may be a tendency for these thicker materials to stretch during material removal operations. In this regard, a length of approximately ¼ inch for the bore 230 will accommodate for this stretching in most applications. However, when relatively light materials are subjected to material removal operations, the insert 268 of FIG. 13 may be utilized in which the length of the corresponding bore 272 therein is approximately 1/16 of an inch and is formed by doming out the lower portion of the insert 276. This insert 276 may be used in the base 232 discussed above (i.e., such that the portion disposal system 244 may be used therewith) or the insert may be used without the portion disposal system 244, such as in the above-described embodiment of the kit assembly 12 for removing material portions of stitchable material.

Once a material portion of the stitchable material has been removed in accordance with the above process, the portion disposal system 244 may be activated to carry away the removed portion. In this regard, a medium, again preferably air, in forced through the port 252 in the shaft 248 such that the air will pass through the inner cavity 256 and the material removal device 160 to propel the removed portion from the end of the device 160. Thereafter, the removed portion passes through the adapter 260 and conduit 264 to an appropriate receptacle (not shown) as discussed above.

A number of alternatives may be utilized for the sources of the mediums for moving the pistons 192 and for use in the portion disposal system 244. In a preferred embodiment, a pneumatic supply system (not shown) is utilized and separate lines (not shown) are used to supply air to the chambers 188 and the portion disposal system 244. This allows the pressure of air supplied to the chambers 188 and the disposal system 244 to be controlled independently. However, the air which is used to drive the pistons 192 in the downward direction, which is evacuated from the chambers 188 when air is applied to the lower ports 204 to reinitialize the positioning of the pistons 192 and thus the material removal device 160 after a single removal operation is completed, may be used to provide the air used by the portion disposal system 244. In this regard, a conduit (not shown) would interconnect one or both of the upper ports 200 with the port 252 in shaft 248 of the disposal system 244.

The above-described drive assembly 180 and portion disposal system 244 may also of course utilize well known electronic or other sensing techniques such that material removal operations and the disposal of the removed portions can be performed in an automated manner, together with the sewing operations, so as to take full advantage of the capabilities of the programmable sewing machine 16. Consequently, the portion disposal system 244 can be activated via these sensing capabilities (i.e., air supplied through the inner cavity 256 of the shaft 248 and through the interior of the material removal device 160) simultaneously with the contacting of the stitchable material by the material removal device 160 or soon thereafter. Preferably, however, the portion disposal system 244 is not activated until the material removal device 160 has completely passed through the stitchable material. This not only may assist in the retraction of the pistons 192, but it reduces the potential for the forced air having an adverse effect on the material removal operations. For instance, in the event that air is provided to the disposal system 244 prior to the material removal device 160 contacting the stitchable material, not only does this provide a braking action to the downward motion of the material cutting device 160 (i.e., by working against the action of the device 160), but it may also undesirably disturb and/or disfigure the stitchable material.

Although the portion disposal system 244 has been described with regard to using a table 224 and support assembly 216 which are detachably connectable to a programmable sewing machine 16 to in effect provide a kit for use with existing machines 16, which again does not require significant modification thereof, the portion disposal system 244 may of course be used with other material removal operation apparatus. For instance, the described portion disposal system 244 may be utilized on a programmable sewing machine 16 in which the casting of the machine 16 is formed to accommodate the permanent incorporation of a material removal system (i.e., a machine 16 in which the cylinder bed 36 effectively incorporates the table 216 and in which the head 24 permanently incorporates the drive assembly 180 for the material removal device 160).

Although the portion disposal system 244 has been described with reference to the use of air for carrying away the removed portion of stitchable material, those skilled in the art will also appreciate that a number of alternatives exist for displacing the removed portion of stitchable material from an end of the material removal device 160. For instance, other pressurized fluids may be utilized. Moreover, the removed portion may be mechanically displaced from the material removal device 160. More particularly, a rod may be propelled through the interior portion of the material removal device 160 by an appropriate drive assembly.

Each of the above-identified embodiments of material removal devices may further include an assembly for aligning the stitchable material relative to the material removal device. That is, in certain applications the stitchable material which is to have material removal and sewing operations performed thereon already has one or more guide holes formed therein. The described alignment feature thereby improves upon the accuracy of the placement of the hole(s) in the stitchable material, as well as the sewing pattern around this hole(s).

Referring to FIG. 15–18, one embodiment of an alignment assembly 398 is illustrated therein as such could be integrated with the material removal device 160 and portion disposal system 244 of FIGS. 9–13. The alignment assembly 398 generally includes a cable 402 having a wire 404 slidably positioned therein. One end of the wire 404 is interconnected with a reciprocable piston of a pneumatic cylinder 410 which is mounted on the sewing machine 16. A second end of the wire 404 is aligned with the bore 230 in the table 224 through which the material removal device 160 travels. Consequently, as the piston of the cylinder 410 reciprocates in a predetermined manner between two positions (e.g., as controlled by appropriate software), the wire 404 moves relative to the cable 402 and the table 244 between two positions. In the alignment position of FIG. 16, the wire 404 extends above the surface of the table 244, and thus is in the path of travel of the material removal device 160. In the retracted position of FIG. 17, the wire 404 is below the table 244 and out of the path of travel of the material removal device 160 so as to not interfere with its operation.

Figure 18:
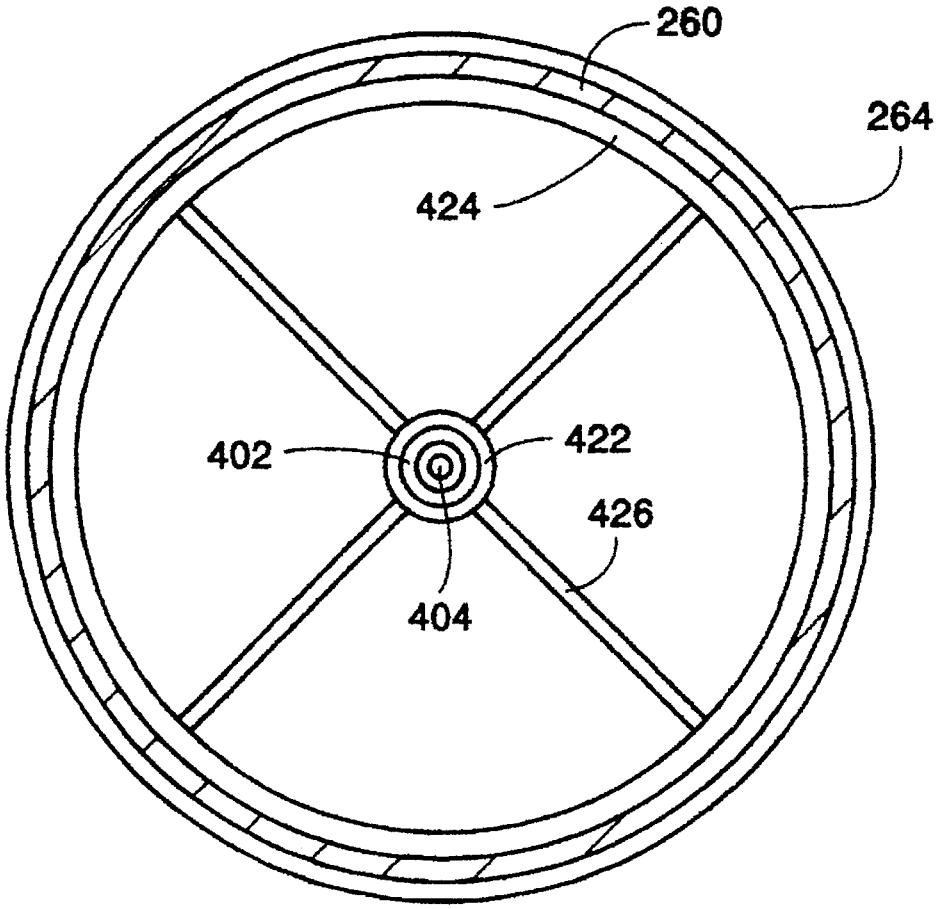
FIG. 18 is a cross-sectional view of the alignment assembly of FIG. 17 taken along lines 400—400.
Figure 19:
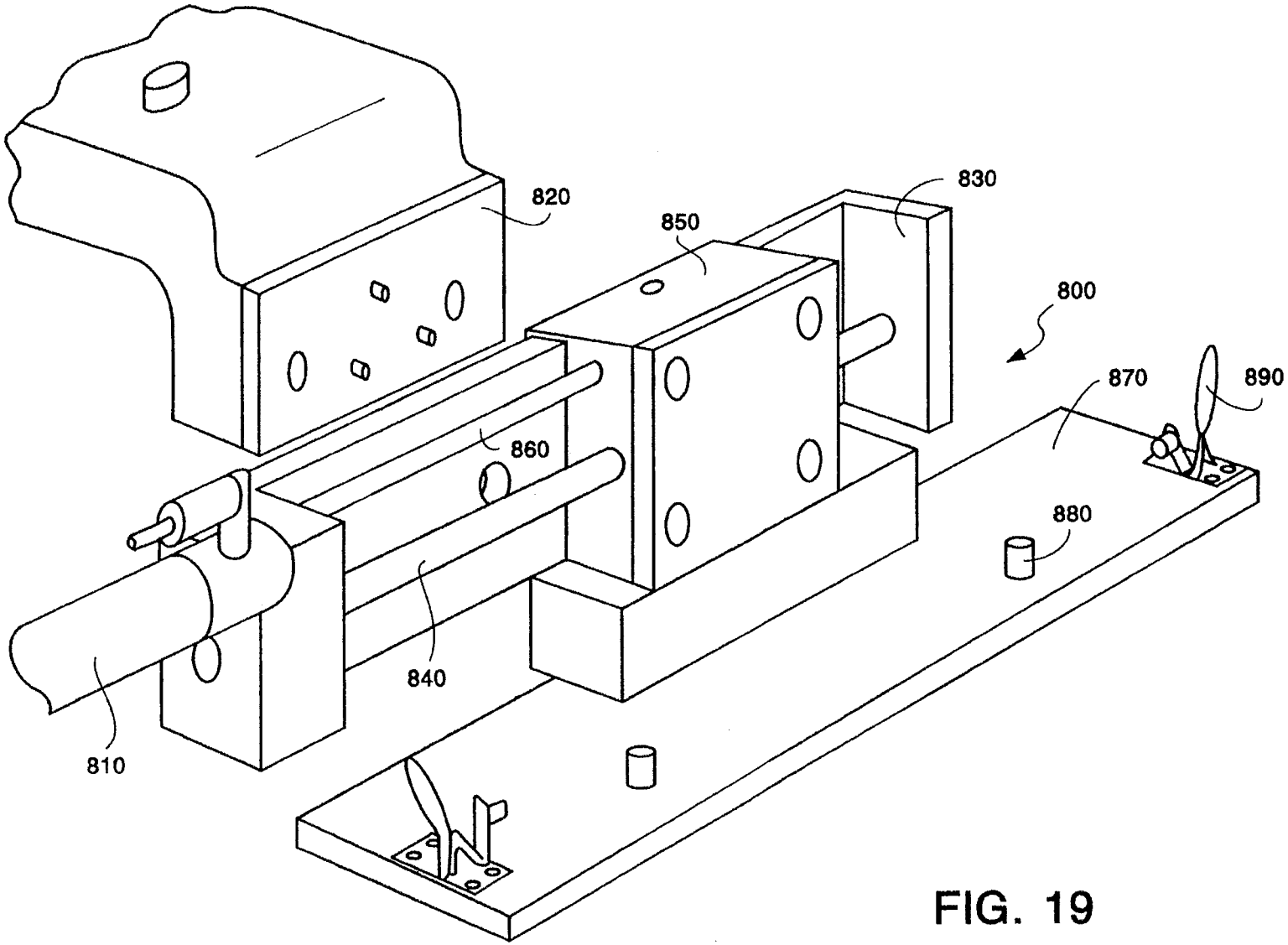
FIG. 19 is a prior art expansion kit for a programmable sewing machine.

As can be appreciated, the manner in which the alignment assembly 398 is incorporated should not interfere with the operation of the portion disposal system 244. In one embodiment, the cable 402 extends through conduit the 264 and is secured to the bell-shaped adapter 260 by a bracket or a clamp assembly 420, and thus is maintained in a fixed position relative to the base 232 of the table 224. As illustrated in FIG. 18, the bracket assembly 420 preferably includes a centrally disposed annular hub 422, and an annular rim 424 connected by a plurality of spokes 426 extending radially from the hub 422 to the rim 424. The cable 402 is appropriately secured to the hub 422 and thus the wire 404 may move relative thereto. Moreover, since there is a space between adjacent spokes 426 this interconnects the alignment assembly 398 without interfering with material disposal operations as described above.

Figure 16:
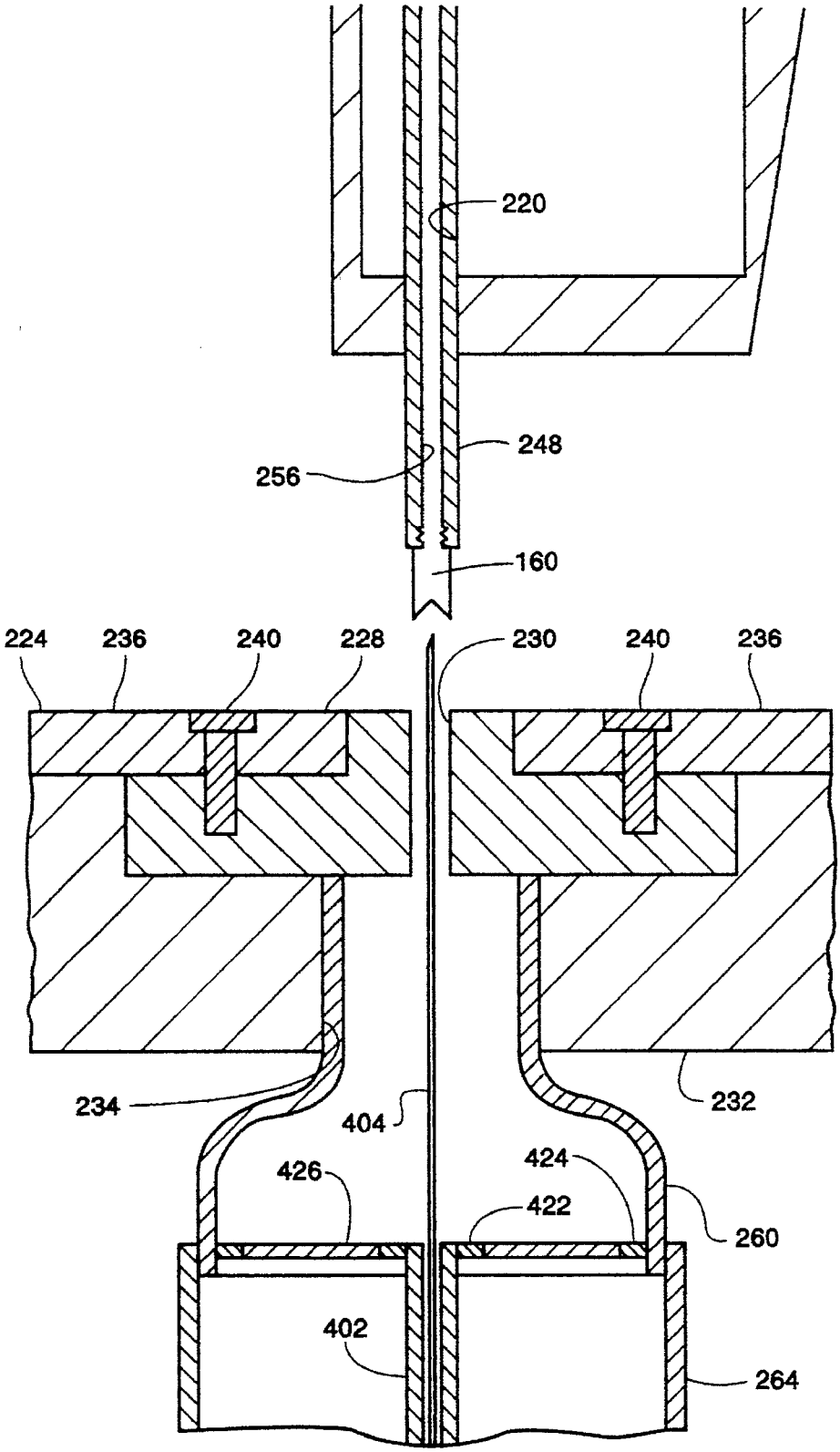
FIGS. 16 and 17 are cross-sectional views of the table of FIG. 12 incorporating the alignment assembly of FIG. 15.

In operation, the alignment assembly 398 is placed in a first position as illustrated in FIG. 16 and the stitchable material is positioned on the portion of wire 404 extending above base 232 using pre-existing guide or positioning holes in the stitchable material. The wire 404 is advanced relative to the cable 402 and the table 244 into this position by activation of the cylinder 410, more particularly by movement of its piston to a predetermined location. In this position, the wire 404 is once again in the path through which the material removal device 160 passes when performing material removal operations on the one or more pieces of stitchable material.

Figure 17:
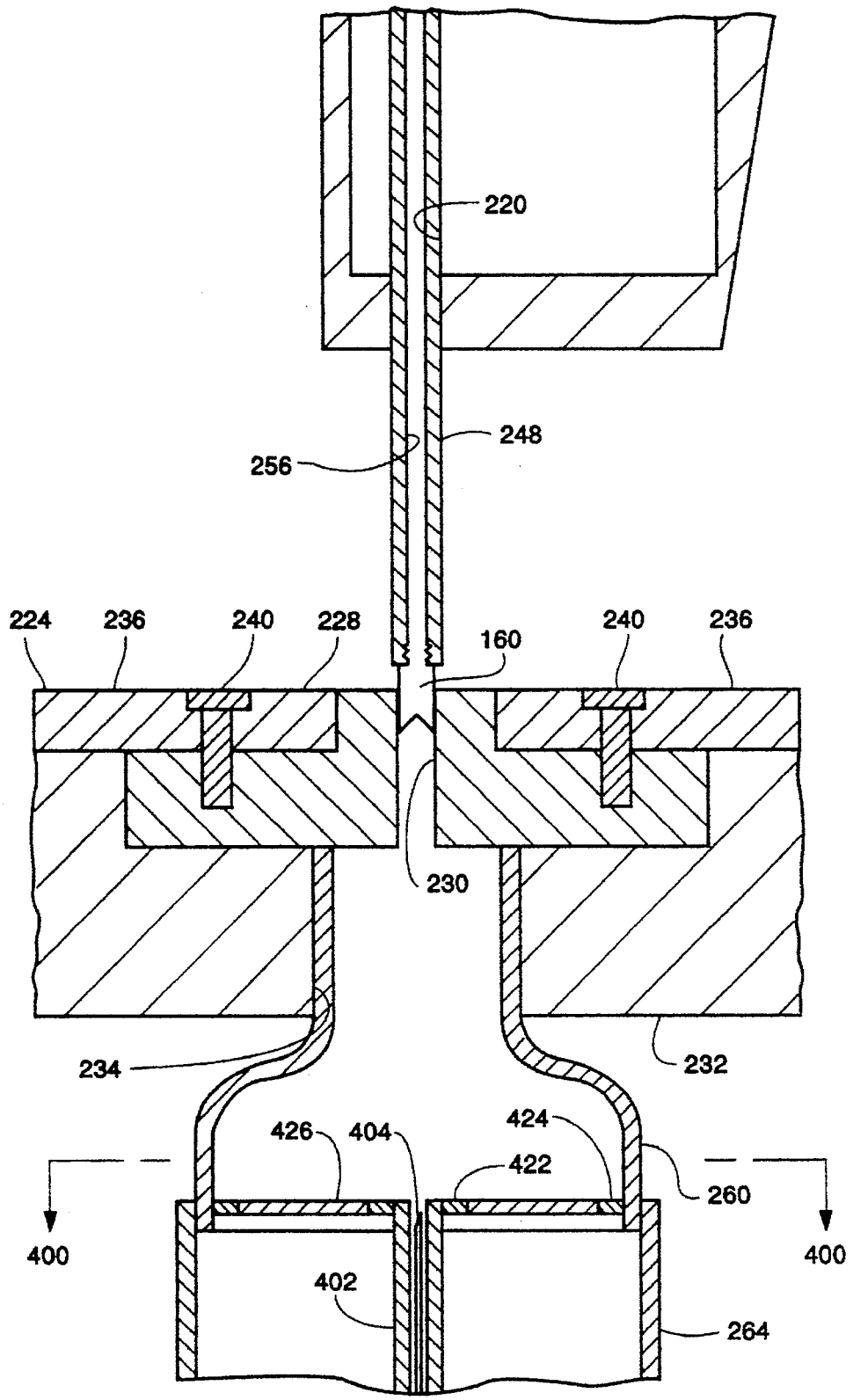

After the one or more pieces of stitchable material are mounted on the wire 404 when in the position illustrated in FIG. 16, the wire 404 is retracted beneath the surface of the table 244 and to a location which is outside of the path of travel of the material removal device 160 so as to not interfere with material removal operations as illustrated in FIG. 17. This movement of the wire 404 is affected by activation of the cylinder 410, more particularly by movement of its piston to another predetermined location which thereby moves the wire 404 relative to the cable 402 and the table 244. Thereafter, material removal and sewing operations may be performed in the above-described manner.

Notwithstanding the foregoing description of how the wire 404 may be moved between the two noted positions, it will be appreciated that other appropriate mechanisms may be utilized. For instance, the wire 404 may be appropriately interconnected with the presser foot or arch clamp assembly 60 of the programmable sewing machine 16. More particularly, when the upper presser foot or arch clamp 64 moves down into engagement with the stitchable material prior to the performance of material removal operations, an appropriate linkage between the upper presser foot 64 and the wire 404 could retract the wire 404 into the position illustrated in FIG. 17. Moreover, when the upper presser foot or arch clamp 64 is raised, for instance to allow for the removal of stitchable material after sewing operations have been completed and/or to insert one or more new pieces of stitchable material for the performance of material removal and sewing operations thereon, the noted linkage would raise the wire 404 into its alignment position as illustrated in FIG. 16.

In addition to the foregoing, it will be appreciated that other mechanical devices may be used to perform the alignment function noted herein. For instance, instead of a wire 404 a pin or the like of sufficient rigidity could be used and moved between the two noted positions to provide an alignment function. Moreover, although only one alignment device is illustrated, it will be appreciated that multiple alignment devices may be used if multiple guide holes are provided in the stitchable material for indicating the location of the desired holes. That is, an alignment assembly may include multiple members which are movable between the two noted positions. Furthermore, it will be appreciated that the alignment assembly 398 may be used when a guide hole(s) is present in the one or more pieces of stitchable material wherein the size of such hole(s) is increased by the material removal device 160, or the alignment assembly 398 may be used to align a prepunched hole at a location which is displaced from the sewing needle 56 of the sewing machine 16. That is, material removal operations need not necessarily be performed when using the alignment assembly 398.

Figure 20:
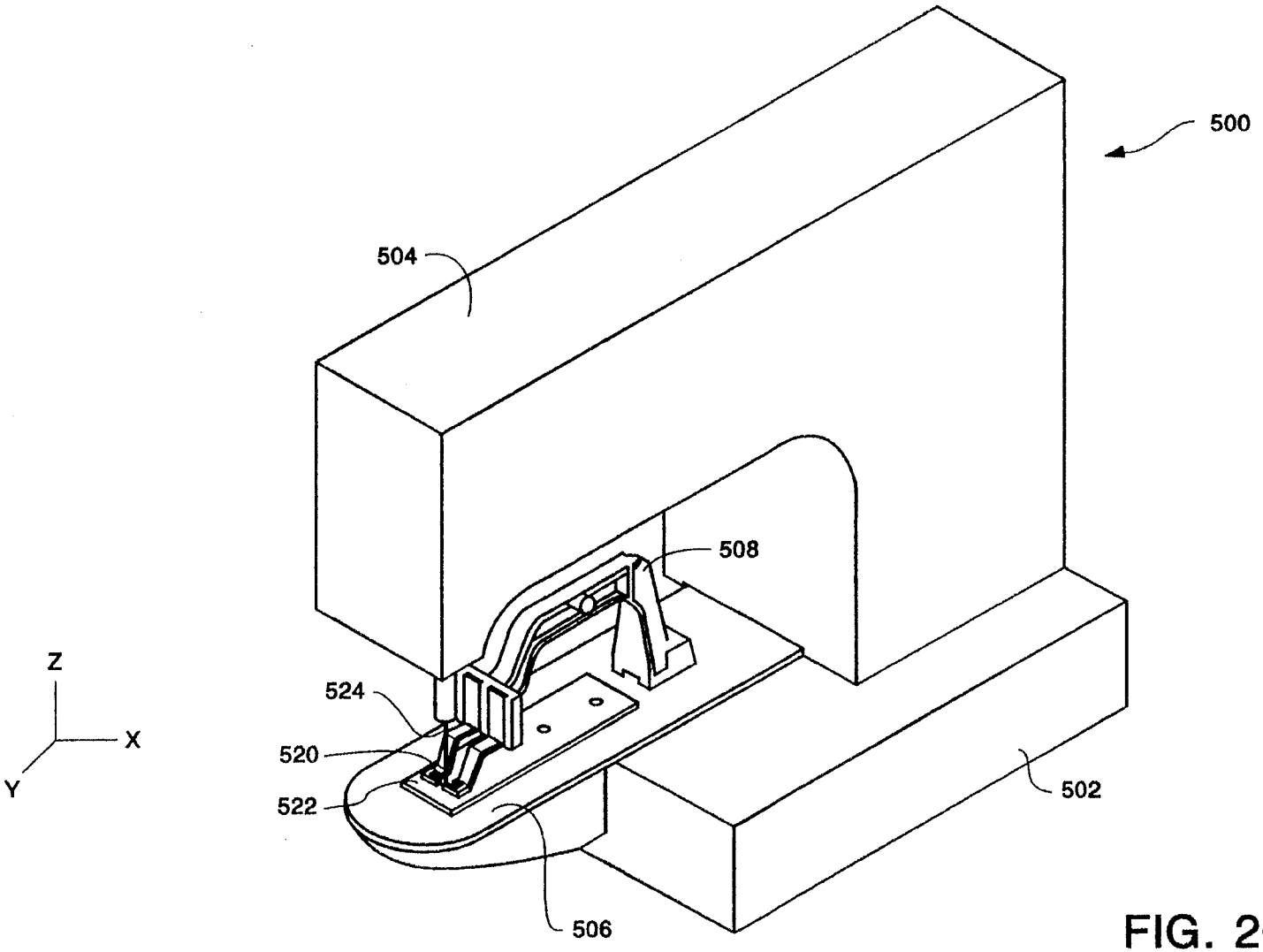
FIG. 20 is a perspective view of a cam-driven sewing machine.

As noted above, the kit assembly 12 of FIGS. 2–8 may also be adapted for use with a cam-driven pattern tacker sewing machine, and would be installed generally in the manner discussed above with regard to the programmable sewing machine 16. Referring to FIG. 20, a cam-driven pattern tacker sewing machine 500 is illustrated therein which includes a base 502 which functions as a support, a sewing head 504 which includes portions of the sewing drive assembly (e.g., the needle bar and not shown) for driving the sewing components of the sewing machine 500 and including a vertically reciprocable sewing needle 124, and a cylinder bed or throat plate 506 below which is positioned other sewing components which interact with the sewing needle 124 (e.g., a bobbin and not shown) to produce a desired stitch and which also serves as a support for the material to be stitched (not shown). An arch clamp 508, including an arch clamp foot 520 detachably connected to the front face of the arch clamp 508, together with a bottom feed plate 522 which is fixedly interconnected with the arch clamp 508 in a manner known in the art (e.g., typically that portion of the arch clamp drive assembly which provides for movement of the arch clamp 508 on the "x" and "y" dimensions), moves the material to be stitched relative to the vertically reciprocating sewing needle 524 to produce the desired stitching pattern.

The particular manner in which the arch clamp 508 and bottom feed plate 522 are advanced to move the stitchable material relative to the vertically reciprocable sewing needle 524 is well known in the art and will not be discussed in detail herein. However, generally a cam drive assembly (not shown) governs the movement of the arch clamp 508 in the "x", "y", and "z" dimensions. More specifically, the cam drive assembly controls the movement of the arch clamp 508 and the attached arch clamp foot 520 in the "z" dimension to compressively engage the stitchable material between the arch clamp foot 520 and the bottom feed plate 522 in preparation for sewing operations (e.g., the bottom feed plate 522 does not move in the "z" dimension), and subsequently to release the stitchable material to allow its removal from the sewing machine 500. Additionally, the cam drive assembly moves the arch clamp 508 and bottom feed plate 522 in a predetermined pattern in the "x" and "y" dimensions during sewing operations (e.g., when stitchable material is held between the arch clamp 508 and the bottom feed plate 522) to produce the desired stitching pattern.

Figure 21:
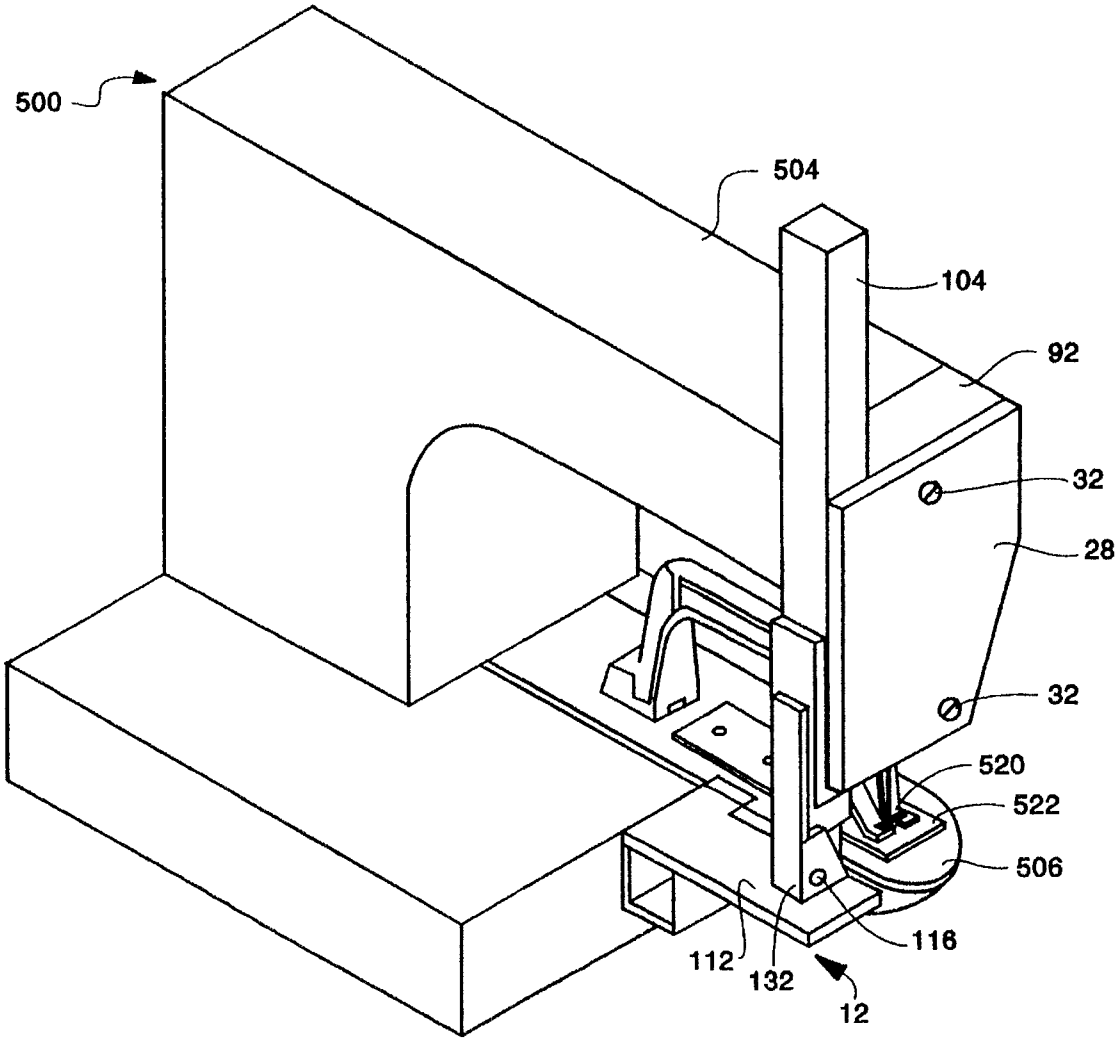
FIG. 21 is a perspective view of the cam-driven sewing machine of FIG. 20 incorporating a material removal unit.

Referring to FIG. 21, the kit assembly 12 is illustrated as being installed on the cam-driven sewing machine 500. As will be appreciated, when the kit assembly 12 is used in conjunction with the cam-driven sewing machine 500, the cam-drive assembly or some other interfacing drive assembly (including manual systems which would not be desirable as one which would have automating capabilities) should control the timing and operation of the kit assembly 12. Moreover, due to the operational distinctions between the cam-driven sewing machine 500 and the programmable sewing machine 16, both of which are again pattern tackers (e.g., the range of motion of the arch clamp of a cam-driven pattern tacker typically being limited to within the sewing area or that general area where sewing operations are performed, versus a programmable pattern tacker which has the ability to move the arch clamp outside of the sewing area as discussed above), an appropriate stitchable material transfer system must be utilized in order to provide for automated buttonhole or the like operations with the cam-driven sewing machine 500 and using the kit assembly 12, one of which is illustrated in FIGS. 22–28.

Figure 22:
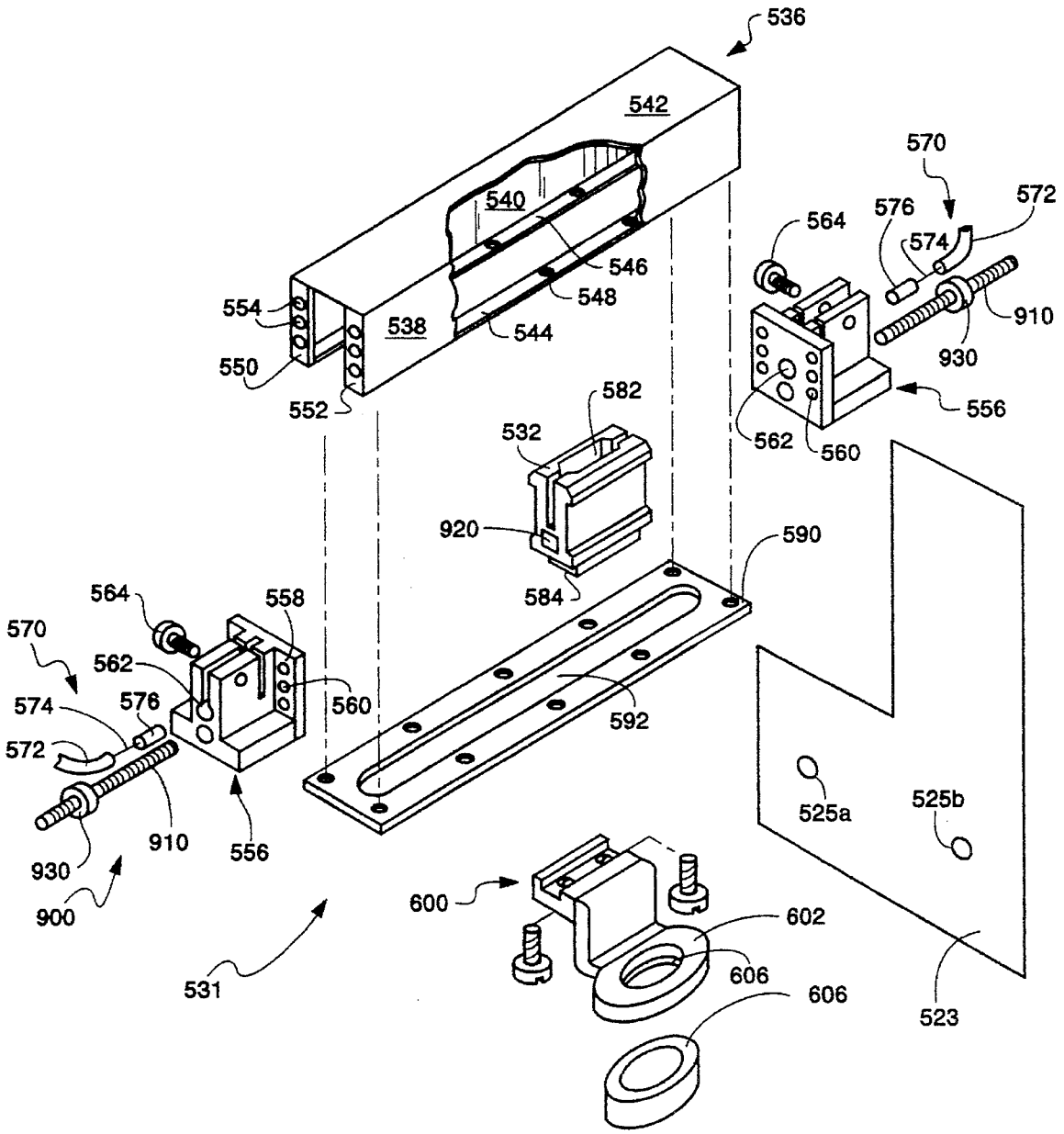
FIG. 22 is an exploded assembly view of one embodiment of a material transfer assembly.
Figure 23:
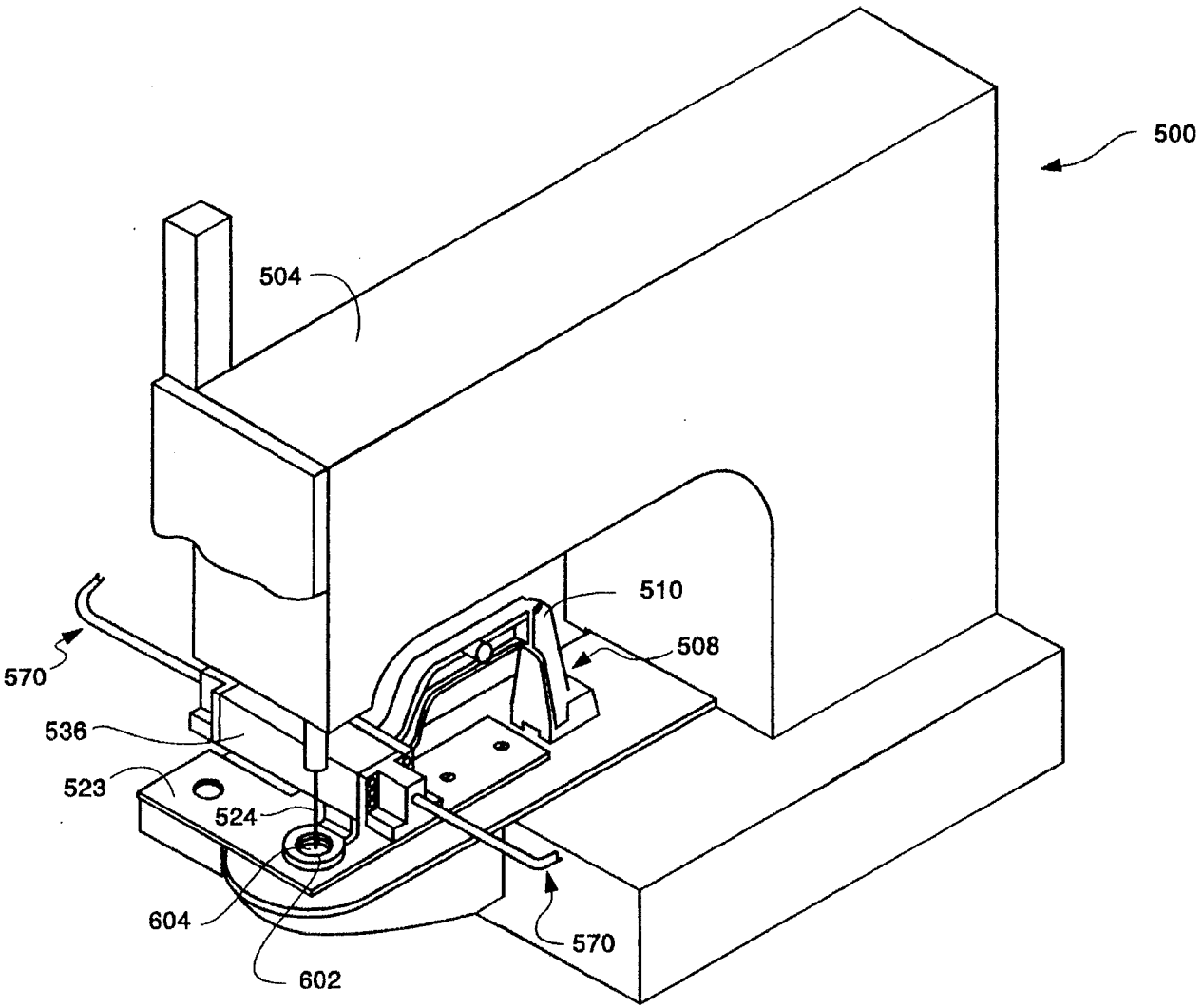
FIG. 23 is a perspective view of the cam-driven sewing machine as illustrated in FIG. 20 incorporating the material transfer assembly of FIG. 21.

Referring initially to FIGS. 22–23, a material transfer assembly 531 is illustrated therein in an exploded view and as attached to the cam-driven sewing machine 500. Generally, the material transfer assembly 531 includes a housing 536 which is fixedly attached to the arch clamp 508 such that it moves simultaneously with the arch clamp 508 during sewing operations. A transfer support member 532 is slidably and movably interconnected with the housing 536 for movement in the "x" dimension. A stitchable material clamp member 600 (e.g., structurally and functionally similar to the arch clamp foot 520) is attached to the transfer support member 532. Moreover, a bottom feed plate 523 having two laterally displaced holes **525*a*, 525*b* (one for the sewing needle 524 (525*b*) and one for the material removal device 120 (525*a*)) with a continuous and uninterrupted surface therebetween is fixedly interconnected with the arch clamp 508 in the above-noted manner (the bottom feed plate 523 thus being part of both the material transfer and sewing assemblies). The stitchable material may thus be compressively engaged between the clamp member 600 and the bottom feed plate 523 by movement of the arch clamp 508 in the "z" dimension (the arch clamp 508 moving in the "z" dimension relative to the generally stationary bottom feed plate 523). Consequently, with the stitchable material being appropriately engaged by the material clamp member 600 and the transfer support member 532, the stitchable material may be moved between at least two positions (e.g., an area generally vertically aligned with the sewing needle 524 and an area generally vertically aligned with the material removal device 120**) to affect the desired transfer of the stitchable material between the material cutting and sewing areas.

With further regard to the housing 536 and as will be discussed in more detail below, preferably the housing 536 is generally small and light so as to allow for high production speeds typically associated with cam-driven pattern tacker sewing machines and so as to not adversely affect the sewing pattern. In this regard, the housing 536 may be formed from materials such as various metals and plastics, but is preferably formed from aluminum for its combined weight reduction and strength characteristics. Moreover, the housing 536 has a length extending laterally in the "x" dimension, a width extending longitudinally in the "y" dimension, and a height extending in the "z" dimension. In one embodiment, the housing 536 measures about 6 inches in length, about ¾ inches in width, and about 1 inch in height. Moreover, the housing 536, together with the sliding block 532 and the clamp member 600, collectively weigh about 5.5 ounces. Notwithstanding these specifics, it will be appreciated that the material selection and/or sizing or weight of the housing 536 may depend upon the particular application.

The housing 536 illustrated in FIG. 22 includes a front wall 538, a back wall 540, and an upper wall 542 which all generally extend the length of the housing 536. The housing 536 further includes a front lip 544 extending rearwardly from the bottom of the front wall 538 and a back lip 546 extending frontwardly from the bottom of the back wall 540. The front lip 544 and the back lip 546 each have a plurality of threaded holes 548 for receiving fasteners for interconnecting a bottom plate 592 with the remainder of the housing 536 as will be discussed in more detail below and after the block 532 is installed. First and second end walls 550,552, respectively, are disposed on each end of the housing 536 to define an open channel therebetween. Each end wall 550, 552 has a plurality of threaded holes 554 for receiving fasteners for interconnecting end plates 556 to the remainder of the housing 536.

The housing 536 further includes the first and second end plates 556 which are substantially identical in configuration. Each end plate 556 includes first and second side webs 558 having a plurality of holes 560 for receiving fasteners to secure the respective end plate 556 to the associated end wall 550, 552 of the housing 536. As will be appreciated, the end plates 556 may also be integrally formed with the front wall 538, back wall 540 and upper wall 542 of the housing 536 (not shown), and in this case the upper wall of the housing would have to be appropriately formed to allow for insertion of the cables 570 (discussed below) therein to affect movement of the sliding block 532 within the housing 536.

The cables 570 allow the sliding block 532 to move within the housing 536 by applying the necessary forces to the block 532. In this regard, each end plate 556 also includes a channel 562 which passes entirely through the end plate 556 for receiving a cable 570. Each cable 570 generally includes a cable housing 572, which may be secured to the associated end plate 556 using the fastening screw 564, and an interior cable 574 which is free to move relative to the cable housing 572. A cable lug 576 is secured to the end of each interior cable 574 and interconnects the interior cables 574 with the sliding block 532. The opposite ends of the interior cables 574 may therefore be interconnected with an appropriate drive assembly such as a pneumatic cylinder (not shown).

The transfer support member, or sliding block 532, is dimensioned to fit within housing 536. Once again, in order to reduce the weight of the transfer assembly 531, the block 532 may be formed from aluminum or other light-weight materials. The sliding block 532 includes a channel 582 for receiving the cable lugs 576 attached to the ends of the cables 570 to connect the interior cables 574 to the sliding block 532. The sliding block 532 further includes a key member 584 dimensioned to fit in sliding engagement within the slot 592 of the bottom plate 590 of the housing 536. After the sliding block 532 is positioned within the housing 536, as will be discussed in more detail below, the bottom plate 590 is secured to the front lip 544 and back lip 546 of housing 536 using conventional fasteners, such as screws.

The material clamp member 600 is secured to the sliding block 532 using conventional fasteners such as threaded screws or bolts. The material clamp member 600 extends generally downwardly from the sliding block 532 and includes a substantially planar support member 602 having a substantially circular aperture 604 disposed therein. A generally circular rubber grommet 606 or other "high-friction" material is secured to the bottom of the support member 602 (e.g., by being press-fit in the aperture 604) to facilitate the frictional engagement of the stitchable material by the support member 602. It will be appreciated by one of ordinary skill in the art that alternate embodiments of the material clamp member 600 may be employed depending upon the particular requirements of the application. For example, different applications may require the support member 602 to be shaped differently. Nonetheless, the support member 602 should include some type of aperture such that the sewing needle 526 and material removal device 120 may pass therethrough.

The housing 536 also includes an adjustment assembly 900 for setting/adjusting the extreme positions of the sliding block 532 within the housing 536. The adjustment assembly 900 generally includes an independently controllable adjustment screw 910 which passes completely through its associated end plate 556 and into the hollow interior of the housing 536. Consequently, each of the screws 910 function as a stop to limit the range of motion of the sliding block 532 within the housing 536. A locking nut 930 may also be included on each screw 910. In order to reduce the potential for damage to the sliding block 532 when engaging these screws 910, a steel insert 920 may be positioned on the two end faces of the sliding block 532 and the ends of the screws 910 may be rounded.

The above-described material transfer assembly 531 is particularly suited for a cam-driven pattern tacker sewing machine. Cam-driven pattern tackers typically are relatively fast moving compared with most programmables. Moreover, the speed of a cam-driven pattern tacker is not as easily controlled as a programmable. In this regard and as noted, the housing 536, sliding block 532, and material clamp member 600 in one embodiment weigh only about 5.5 ounces. Moreover, the adjustability of the extreme positions of the sliding block 532 within the housing 536 by the independently adjustable screws 910 allows for the cut or opening in the stitchable material and the sewing pattern on the stitchable material to be accurately placed. This is particularly relevant when considering cam-driven pattern tackers since it is relatively more difficult to achieve exact positionings with cams than by programming.

The material transfer assembly 531 illustrated in FIG. 22 may be assembled from the above-described components as follows. First, each of the cables 570 are connected to the associated end plate 556 by passing the cables 570 through the associated channel 562 extending through the associated end plates 556. Next, the interior cables 574 are connected to the sliding block 532 by inserting the connector lugs 576 into the receiving channel 582 in the sliding block 532. The end plates 556 may then be secured to the end walls 550, 552 of the housing 536 using convention fasteners such as threaded bolts or screws. Similarly, the bottom plate 590 may be secured to the front and back lips 544, 546 respectively, of the housing 536 using conventional fasteners such as threaded bolts or screws. Finally, the foot member 600 is secured to the sliding block, as indicated in FIG. 22, using conventional fasteners, such as threaded screws.

As noted, FIG. 23 illustrates the material transfer assembly 531 as such could be mounted on the cam-driven sewing machine 500 for moving the stitchable material laterally in the "x" dimension between the material removal area (e.g., the area generally vertically aligned with the material removal device 140) and the sewing area (e.g., the area generally vertically aligned with the sewing needle 524). Portions of the kit assembly 12 have been cut away in FIG. 23 to allow a clearer view of the material transfer assembly 531. To secure the material transfer assembly 531 to the arch clamp 508, the arch clamp foot 520 is removed and the housing 536 is connected to the front face of the arch clamp 508 using conventional fasteners, such as threaded screws, in the manner illustrated in FIG. 23. Preferably, the housing 536 is secured to the arch clamp 508 in a position that allows the aperture 604 of the material clamp member 600 to be positioned directly below the cutting head 128 of the material removal device 120 (FIG. 3) when sliding block 532 is in a first position within housing 536 (e.g., the left-most position of the block 532 in the housing 536), and is positioned directly below the sewing needle 524 when the sliding block 532 is at a second position within the housing 536 as depicted in FIG. 23 (e.g., the right-most position of the block 532 in the housing 536). The free ends of the cables 570, specifically the interior cables 574, are again connected to a conventional pneumatic cylinder assembly or other appropriate drive system (not shown) to affect lateral motion of the slide block 532 between the first and second positions within the housing 536. Moreover, the bottom feed plate 522 illustrated in FIG. 20 has again been replaced with the generally L-shaped bottom feed plate 523 illustrated in FIG. 23 to provide a smooth surface across which the stitchable material may move in the "x" dimension (e.g., the lateral extent of the bottom feed plate in the "x" dimension is at least as great as the range of motion of the sliding block 532 in the "x" dimension). Since the sliding block 532 and the clamp member 600 slide the stitchable material across the bottom feed plate 523 during transfer operations, it is desirable for the upper surface of the bottom feed plate 523 to have reduced friction characteristics. For instance, the bottom feed plate 523 may be formed from materials such as stainless steel or steel coated with a slick material to provide this function.

FIGS. 24–28 illustrate a typical material transfer cycle using the material transfer assembly 531. For ease of illustration, the front wall 538 has been removed. Although FIGS. 24–28 illustrate the assembly 531 using a continuous length of material 610, it will be appreciated that the invention is equally applicable to discrete pieces of stitchable material.

Figure 24:
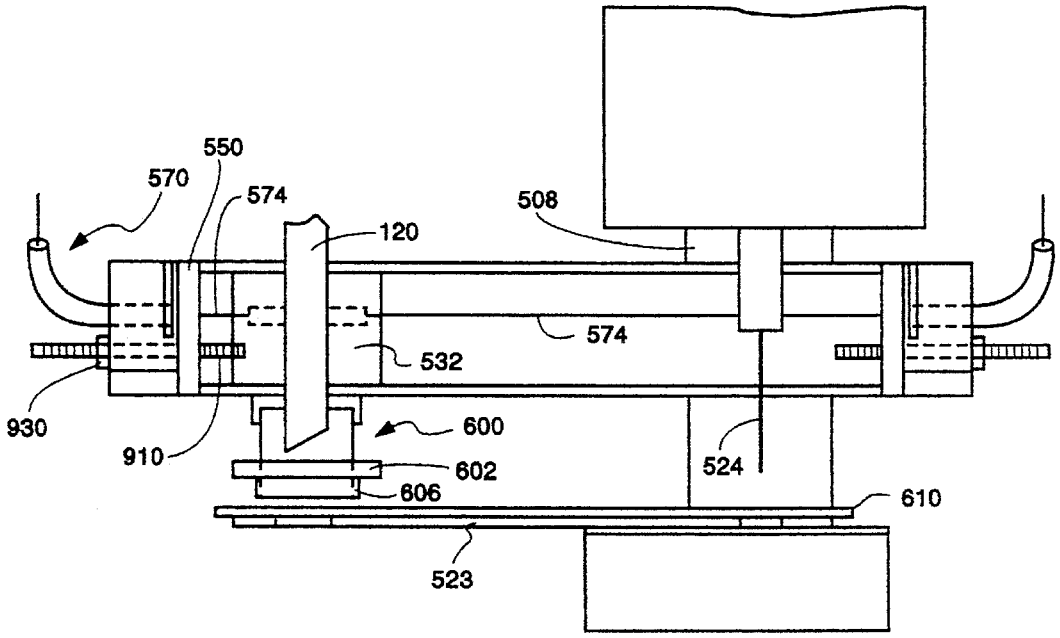
FIGS. 24–28 are front, cutaway views which illustrate the sequence of operations in a material transfer cycle.

FIG. 24 illustrates the material transfer assembly 531 at the beginning of a material transfer cycle with the arch clamp 508 in its vertically raised position. The sewing machine 500 is not in operation at this point in the cycle (i.e., no sewing operations are being performed), and the material clamp member 600 is positioned directly beneath the cutting head of the material removal device 120, but also is raised above the material 610. Moreover, the aperture 606 is vertically aligned with the material device 120 in the position established by the engagement of the left adjustment screw 910 on the sliding block 532.

Figure 25:
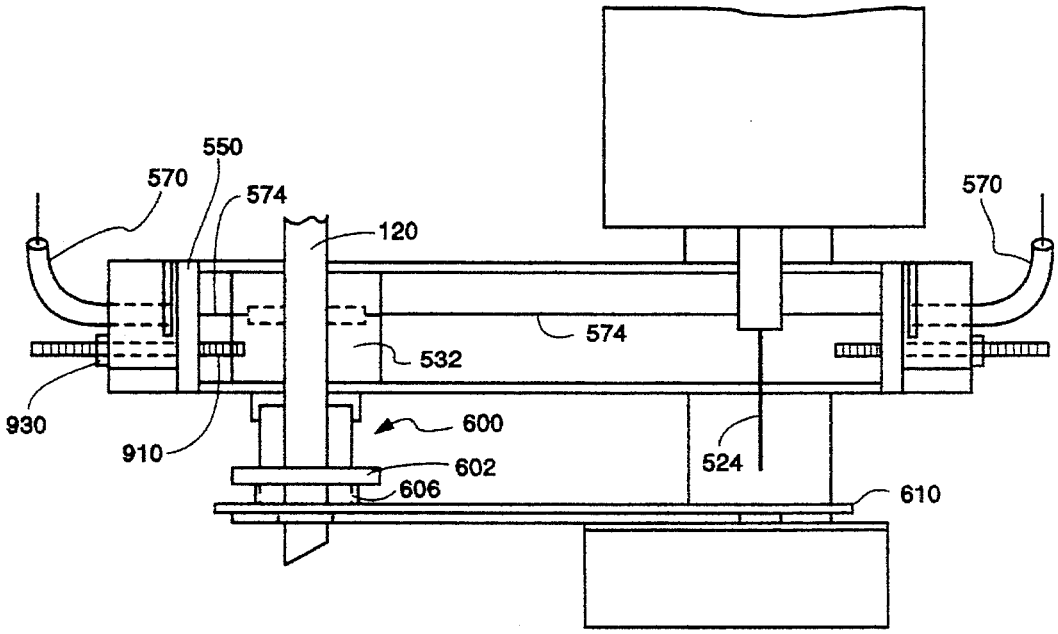

In FIG. 25, the arch clamp 508 is lowered by cams or an air cylinder (not shown) of the sewing machine 500 which causes the rubber grommet 606 of material clamp member 600 to compressively engage the material 610. At this point in the cycle, the material removal device 120 may be actuated in the manner discussed above, thereby causing the cutting head of the material removal device 120 to pass through the material 610 to cut a hole or other type of opening in the material 610.

Figure 26:
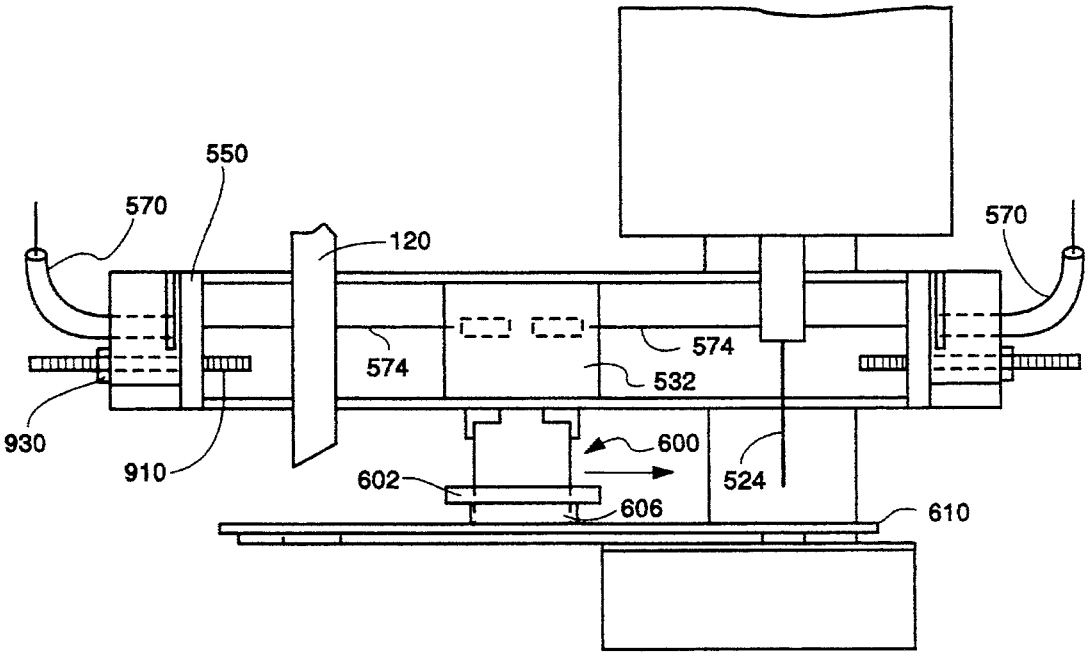
Figure 27:
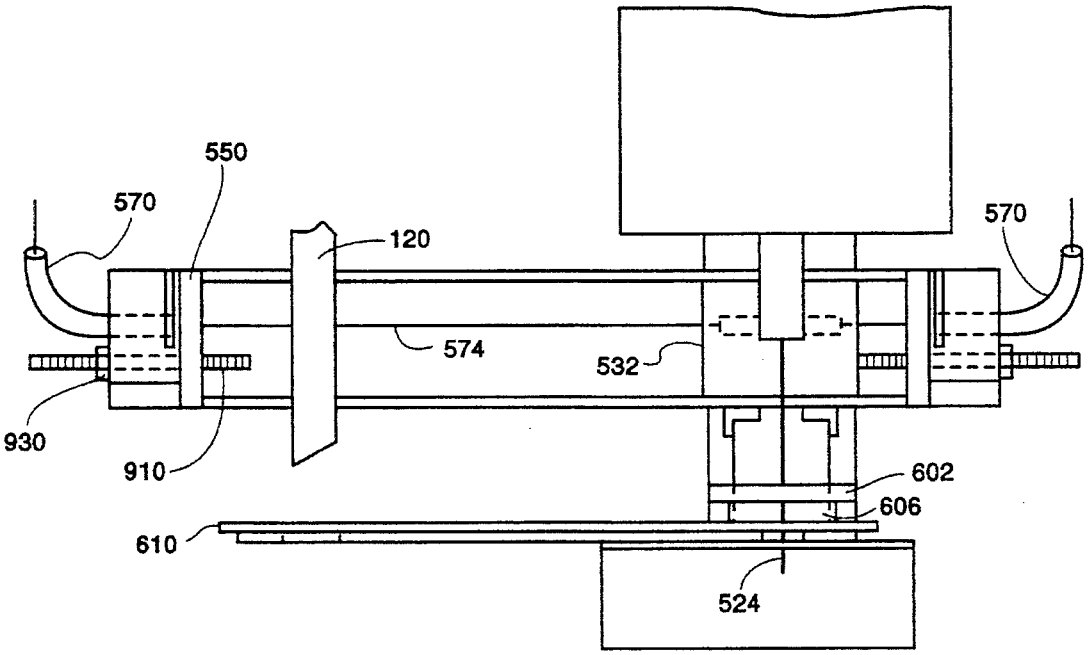

After the cutting head 128 retracts from the material, the pneumatic cylinder or other drive mechanism for the material transfer assembly 531 is actuated to cause the sliding block 532, and therefore the compressively engaged material 610, to move toward the sewing needle 524, as illustrated in FIG. 26. That is, the right interior cable 574 is retracted by the noted drive assembly and the left interior cable 574 "lengthens" or extends. During the movement, the sliding block 532 and the clamp member 610 slide the material 610 over the stationary bottom feed plate 523 while in compressive engagement therewith. In this regard, the smooth, continuous uninterrupted upper surface of the bottom feed plate 523 facilitates this movement in the required accuracies, together with its reduced friction surface. When the sliding block 532 reaches the extreme right end of its range of travel as established by the right adjustment screw 910, the aperture 604 in the material clamp member 600 is positioned directly beneath the sewing needle 524, as illustrated in FIG. 27. At this point in the cycle sewing operations may take place by moving the arch clamp 508 and the bottom feed plate 523 relative to the vertically reciprocating needle 524, as discussed above. Generally, the sliding block 532 is maintained in a fixed position relative to the arch clamp 508 and the housing 536 during sewing operations. This may be accomplished by maintaining a proper tension on at least one of the interior cables 574. In the disclosed embodiment, it is intended that sewing operations occur substantially entirely within the circular aperture 606 in the material clamp member 600.

Figure 28:
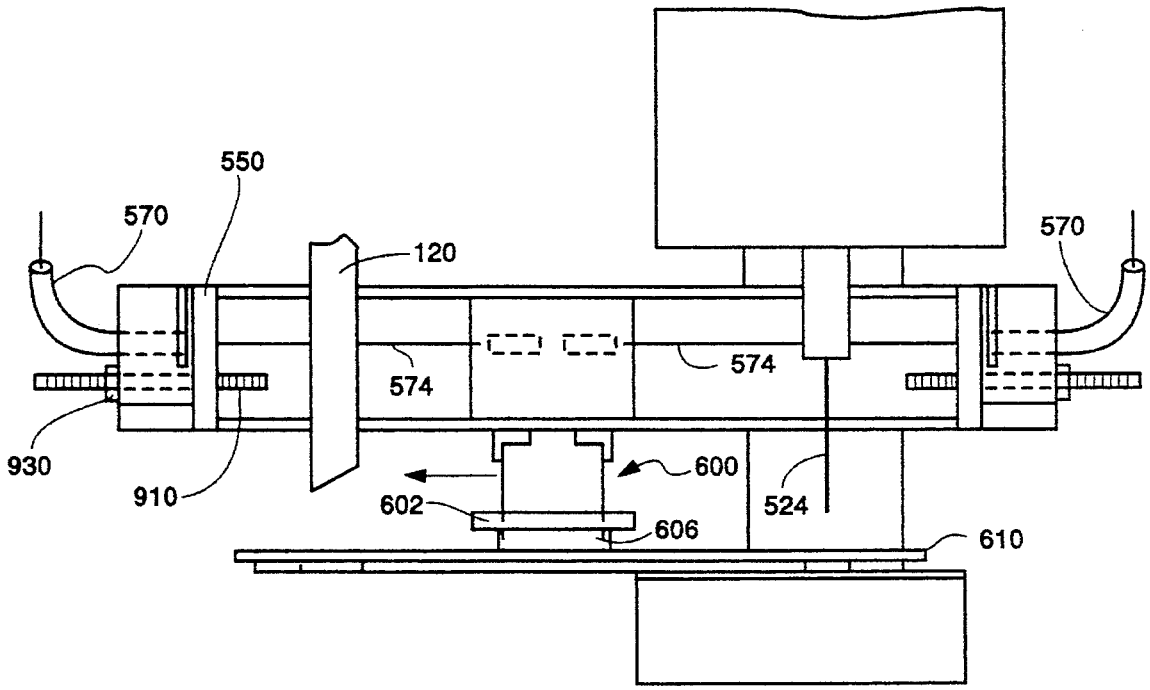

After sewing operations are completed the arch clamp 508 moves upwardly to release the material 610 from the compressive engagement provided by the clamp member 600 and the bottom feed plate 523, and the pneumatic cylinder driving for the material transfer assembly 531 is actuated to return the sliding block 532 toward the left end of the housing 536 as illustrated in FIG. 28 and as established by the left adjustment screw 910. That is, the block 532 is positioned opposite the sewing needle 524 to position the aperture 606 in the material clamp member 600 directly beneath the cutting head 128 of the material removal device 120 as illustrated in FIG. 24 discussed above. At this point the material transfer cycle may be repeated if desired.

Although the material transfer assembly 531 has been described in relation to using the kit assembly 12 in combination with the cam-driven sewing machine 500, it will be appreciated that the transfer assembly 531 would be equally applicable to a cam-driven pattern tacker machine which integrally included material removal structure with the sewing structure. Moreover, as in the above case, sewing operations may be performed before material cutting operations. That is, the slide block 532 would initially be positioned in the sewing area and sewing operations would be performed with the material 610 being engaged between the clamp member 600 and the bottom feed plate 532. Thereafter, the slide block 532 would move the stitchable material 610 over to the material cutting area by sliding the material 610 over the feed plate 523 while exerting a compressive force thereon. Finally, the material removal device 120 would pass through the material 610.

The foregoing description of the invention has been presented for purposes of illustration and description. Further, the description is not intended to limit the invention to the form disclosed herein. Consequently, variations and modifications commensurate with the above teachings, in the skill or knowledge of the art, are within the scope of the present invention. The embodiments described hereinabove are further intended to explain best modes known of practicing the invention and to enable others skilled in the art to utilize the invention in such, or other, embodiments and with the various modifications required by their particular applications or uses of the invention. It is intended that the appended claims be construed to include alternative embodiments to the extent permitted by the prior art.

What is claimed is:

1. A material transfer assembly for a pattern tacker sewing machine, said sewing machine comprising a vertically reciprocable sewing needle and a movable arch clamp, said arch clamp being movable laterally in an "x" dimension, longitudinally in a "y" dimension perpendicular to the "x" dimension, and vertically in a "z" dimension, wherein the arch clamp affects movement of a stitchable material relative to the sewing needle in the "x" and "y" dimensions in a predetermined manner to sew a predetermined pattern on the stitchable material, said transfer assembly comprising:

a bottom feed plate fixedly interconnectable with said arch clamp and comprising first and second laterally displaced holes in the "x" dimension and a continuous surface between said first and second holes;

a transfer support movably interconnectable with the arch clamp, wherein said transfer support is movable in the "x" dimension;

a stitchable material clamp member connectable to said transfer support, wherein a movement of the arch clamp in the "z" dimension toward the stitchable material compressively engages said clamp member on the stitchable material against said bottom feed plate; and a transfer support drive assembly, wherein said transfer support is moved between at least first and second positions relative to the arch clamp in the "x" dimension by said transfer support drive assembly when sewing operations are not being performed, and wherein at least a portion of said transfer support is substantially vertically aligned with said first and second holes in said bottom feed plate when in said first and second positions, respectively.

2. A material transfer assembly, as claimed in claim 1, further comprising a housing fixedly connectable to the arch clamp, wherein said transfer support is slidably interconnectable with said housing for movement in the "x" dimension.

3. A material transfer assembly, as claimed in claim 2, wherein said housing comprises means for restricting movement of said transfer support relative to said housing to a movement only in the "x" dimension.

4. A material transfer assembly, as claimed in claim 2, wherein said housing comprises a laterally extending slot and said transfer support comprises a projection positionable within said slot, said slot extending in the "x" dimension.

5. A material transfer assembly, as claimed in claim 2, further comprising means for independently adjusting a location of each of said first and second positions of said transfer support, said means for adjusting interfacing with said housing.

6. A material transfer assembly, as claimed in claim 2, wherein said housing further comprises first and second laterally displaced adjustable stops in the "x" dimension, wherein said first and second adjustable stops define said first and second positions of said transfer support, respectively.

7. A material transfer assembly, as claimed in claim 1, wherein said stitchable material clamp member comprises a high friction engagement member for engaging the stitchable material.

8. A material transfer assembly, as claimed in claim 7, wherein said high friction engagement member comprises rubber.

9. A material transfer assembly, as claimed in claim 7, wherein said stitchable material clamp member further comprises a clamp support having an aperture, wherein a first portion of said engagement member is disposed in said aperture and a second portion of said engagement member extends below a lower surface of said clamp member for engaging the stitchable material.

10. A material transfer assembly, as claimed in claim 1, further comprising means for adjusting a location of each of said first and second positions of said transfer support.

11. A material transfer assembly, as claimed in claim 10, wherein said means for adjusting comprises means for independently adjusting said location of said first position of said transfer support and means for independently adjusting said location of said second position of said transfer support.

12. A material transfer assembly, as claimed in claim 1, wherein said transfer assembly further comprises means for maintaining said transfer support in a fixed position relative to the arch clamp during sewing operations.

13. A material transfer assembly, as claimed in claim 12, wherein said means for maintaining comprises said transfer support drive assembly.

14. A sewing/material cutting assembly, comprising:

a sewing assembly comprising a vertically reciprocable sewing needle, and an arch clamp, wherein said arch clamp is movable laterally in an "x" dimension, longitudinally in a "y" dimension perpendicular to said "x" dimension, and vertically in a "z" dimension, wherein said arch clamp may be moved in said "z" dimension toward a stitchable material to compressively engage the stitchable material and wherein said arch clamp may be moved in said "x" and "y" dimensions in a predetermined manner to move the stitchable material relative to said vertically reciprocable sewing needle for sewing a predetermined pattern on the stitchable material, and wherein extreme positions of said arch clamp during sewing operations define a sewing area;

a stitchable material cutting assembly displaced from said sewing area, interconnected with said sewing assembly, and comprising a material cutting area; and stitchable material transfer assembly comprising a transfer support movably interconnected with said arch clamp, a stitchable material clamp member attached to said transfer support, and a transfer drive assembly interconnected with said transfer support, wherein said transfer support moves the stitchable material between said material cutting and sewing areas using said transfer drive assembly.

15. A sewing/material cutting assembly, as claimed in claim 14, wherein said material cutting assembly comprises a stitchable material punch.

16. A sewing/material cutting assembly, as claimed in claim 14, wherein said transfer assembly further comprises a housing attached to said arch clamp, wherein said transfer support is slidably interconnected with said housing for movement in said "x" dimension.

17. A sewing/material cutting assembly, as claimed in claim 16, wherein said housing comprises means for restricting movement of said transfer support relative to said housing to a movement only in said "x" dimension.

18. A sewing/material cutting assembly, as claimed in claim 16, wherein said housing comprises a laterally extending slot and said transfer support comprises a projection positionable within said slot, said slot extending in said "x" dimension.

19. A material transfer assembly, as claimed in claim 16, further comprising means for independently adjusting a location of each of said first and second positions of said transfer support, said means for adjusting interfacing with said housing.

20. A material transfer assembly, as claimed in claim 16, wherein said housing further comprises first and second laterally displaced adjustable stops in the "x" dimension, wherein said first and second adjustable stops define said first and second positions of said transfer support, respectively.

21. A sewing/material cutting assembly, as claimed in claim 14, wherein said stitchable material clamp member comprises a high friction engagement member for engaging the stitchable material.

22. A sewing/material cutting assembly, as claimed in claim 21, wherein said high friction engagement member comprises rubber.

23. A sewing/material cutting assembly, as claimed in claim 21, wherein said stitchable material clamp member further comprises a clamp support having an aperture, wherein a first portion of said engagement member is disposed in said aperture and a second portion of said engagement member extends below a lower surface of said clamp support.

24. A sewing/material cutting assembly, as claimed in claim 14, wherein said transfer assembly further comprises means for maintaining said transfer support in a fixed position relative to said arch clamp during sewing operations.

25. A sewing/material cutting assembly, as claimed in claim 24, wherein said means for maintaining comprises said transfer support drive assembly.

26. A sewing/material cutting assembly, as claimed in claim 14, further comprising a bottom feed plate fixedly attached to said arch clamp and extending laterally within both said material cutting and sewing areas.

27. A sewing/material cutting assembly, as claimed in claim 26, wherein said bottom feed plate comprises first and second laterally displaced holes in said material cutting and sewing areas.

28. A sewing/material cutting assembly, as claimed in claim 14, wherein said stitchable material clamp further comprising a clamp support having an aperture and an engagement member partially disposed in said aperture and extending below a lower surface of said clamp support, said sewing/material cutting assembly further comprising a bottom feed plate fixedly interconnected with said arch clamp and extending laterally within both said material cutting and sewing areas said bottom feed plate comprising first and second laterally displaced holes in said material cutting and sewing areas and a continuous surface therebetween, wherein said bottom feed plate remains stationary during movement of said transfer support relative to said arch clamp and said bottom feed plate moves with said arch clamp during sewing operations.

29. A method for performing sewing and material removal operations on a stitchable material using a sewing/material cutting assembly comprising a sewing assembly, wherein sewing operations are performed in a sewing area, a stitchable material cutting assembly displaced from said sewing assembly and comprising a material cutter, wherein material cutting operations are performed in a material cutting area, and a transfer assembly, wherein said transfer assembly transfers a stitchable material between said sewing and stitchable material cutting assemblies, said sewing assembly comprising a sewing needle, an arch clamp, and a bottom feed plate with first and second displaced holes, said first hole being aligned with said sewing needle and said second hole being aligned with said material cutter, said transfer assembly comprising a transfer support movably interconnected with said arch clamp and a stitchable material clamp member connected to said transfer support, said method comprising the steps of:

positioning the stitchable material on at least said bottom feed plate;

moving said transfer support to said material cutting area and relative to said arch clamp and said bottom feed plate;

compressively engaging said stitchable material clamp on the stitchable material and said bottom feed plate;

passing said material cutter through the stitchable material during said compressively engaging step;

moving said transfer support between said material cutting area and said sewing area, and relative to said arch clamp and said bottom feed plate, during said compressively engaging step; and sewing a pattern on the stitchable material in said sewing area, said sewing step comprising moving said arch clamp and said bottom feed plate relative to said sewing needle during said compressively engaging step.

30. A method, as claimed in claim 29, wherein said compressively engaging step is performed after said moving said transfer support to said material cutting area step.

31. A method, as claimed in claim 29, wherein said compressively engaging step is performed before said moving said transfer support to said material cutting area step.

32. A method, as claimed in claim 29, further comprising the step of maintaining said transfer support in a stationary position relative to said arch clamp during said sewing step.

33. A method, as claimed in claim 29, wherein said passing step is performed before said sewing step.

34. A method, as claimed in claim 29, wherein said passing step is performed after said sewing step.

* * * * *